US008782826B2

(12) United States Patent
White et al.

(10) Patent No.: US 8,782,826 B2
(45) Date of Patent: Jul. 22, 2014

(54) SYSTEM AND METHOD FOR TRANSFERRING PATIENTS

(71) Applicant: CEGA Innovations, LLC, Sioux Falls, SD (US)

(72) Inventors: Ty A. White, Sioux Falls, SD (US); Aaron J. Emerson, Sioux Falls, SD (US)

(73) Assignee: CEGA Innovations, LLC, Sioux Falls, SD (US)

( * ) Notice: Subject to any disclaimer, the term of this patent is extended or adjusted under 35 U.S.C. 154(b) by 0 days.

(21) Appl. No.: 13/626,457

(22) Filed: Sep. 25, 2012

(65) Prior Publication Data

US 2013/0269101 A1 Oct. 17, 2013

Related U.S. Application Data

(60) Provisional application No. 61/624,527, filed on Apr. 16, 2012.

(51) Int. Cl.
*A61G 7/00* (2006.01)

(52) U.S. Cl.
USPC ..... 5/81.1 C; 5/81.1 R

(58) Field of Classification Search
USPC ..... 5/81.1 C, 81.1 HS, 81.1 R; 198/300, 312, 198/318, 321
See application file for complete search history.

(56) References Cited

U.S. PATENT DOCUMENTS

| | | | | |
|---|---|---|---|---|
| 3,947,902 | A | 4/1976 | Conde et al. | |
| 4,073,016 | A | 2/1978 | Koll | |
| 4,077,073 | A | 3/1978 | Koll et al. | |
| 4,813,088 | A * | 3/1989 | DiMatteo et al. | 5/81.1 C |
| 5,781,943 | A * | 7/1998 | Moenning et al. | 5/81.1 C |
| 5,802,632 | A * | 9/1998 | Campbell | 5/81.1 C |
| 6,857,143 | B2 | 2/2005 | McNulty | |
| 6,932,209 | B2 | 8/2005 | Kasagami et al. | |
| 7,047,578 | B2 | 5/2006 | Spanton | |
| 7,540,043 | B2 * | 6/2009 | Stackley et al. | 5/81.1 C |
| 7,578,011 | B2 * | 8/2009 | Johnson | 5/81.1 R |

(Continued)

FOREIGN PATENT DOCUMENTS

SU 1090388 A1 5/1984

OTHER PUBLICATIONS

Written opinion for corresponding international application No. PCT/US2013/036830 mailed on Aug. 15, 2013.

(Continued)

*Primary Examiner* — Robert G Santos
*Assistant Examiner* — Richard G Davis
(74) *Attorney, Agent, or Firm* — Dorsey & Whitney LLP

(57) ABSTRACT

A system for transferring an object from a first surface to a second surface that includes a housing dimensioned to span a distance between the first surface and the second surface, a first elongated roller positioned along a first edge of the housing, and a second elongated roller positioned along a second edge of the housing. A continuous belt is positioned in conveying relation with respect to the first roller and the second roller. A portion of the continuous belt conveys an object while another portion of the continuous belt passes through the housing. The continuous belt does not touch the first or second surface. A support structure having at least one portion positioned within the continuous belt is connected to a first end and a second end of the housing.

17 Claims, 17 Drawing Sheets

(56) References Cited

U.S. PATENT DOCUMENTS

| | | | | |
|---|---|---|---|---|
| 7,748,062 | B2 | 7/2010 | McNulty | |
| 2001/0047543 | A1* | 12/2001 | VanSteenburg et al. | 5/81.1 C |
| 2003/0182723 | A1 | 10/2003 | Kasagami et al. | |
| 2005/0066442 | A1 | 3/2005 | Kasagami et al. | |
| 2006/0174405 | A1 | 8/2006 | Johnson | |
| 2006/0225202 | A1* | 10/2006 | Stackley et al. | 5/81.1 C |
| 2009/0159396 | A1* | 6/2009 | Wood | 198/318 |
| 2012/0084914 | A1* | 4/2012 | Patterson et al. | 5/81.1 C |

OTHER PUBLICATIONS

International search report for corresponding international application No. PCT/US2013/036830 mailed on Aug. 15, 2013.

* cited by examiner

SYSTEM AND METHOD FOR TRANSFERRING PATIENTS

RELATED APPLICATIONS

This application claims the benefit under 35 U.S.C. §119 (e) of prior U.S. Provisional Patent Application No. 61/624,527, filed Apr. 16, 2012, which is incorporated herein by reference.

TECHNICAL FIELD

Various embodiments described herein relate to a method and a system for transferring objects, such as patients, in a hospital or in an operating suite.

BACKGROUND

In the day to day operations of a hospital, many patients are moved. In many instances, patients are ambulatory and can move from a hospital bed to a wheelchair to be moved yet again. Many patients are not ambulatory. These patients must also be moved with the assistance of nursing and medical staff. Non-ambulatory patients are moved from a hospital bed to a gurney whenever there is a need to move a patient to a new area. Once moved to the new area, they are moved again into a new room or other environment. When a patient undergoes surgery, even the ambulatory patient is generally rendered non-ambulatory due to the effects of anesthesia. Generally, the anesthesia does not wear off shortly after concluding the operation. A patient is generally moved from the operating table in an operating suite to a bed in a recovery room. In the recovery room, the patient is observed until they "wake up" after the anesthesia wears off. In the recovery room, a nurse can also keep an eye on many patients in the event something should go wrong shortly after an operation. Once the patient awakens or recovers sufficiently, the patient is then moved again to a hospital room. Most patients are rendered non-ambulatory by virtue of the operation. As a result, the nursing and medical staff must move the patient onto a gurney for transport back to the recovery room. Generally, the patient stays on the gurney while in the recovery room. Upon recovery, the patient is then moved on the gurney to the hospital room. Once at the hospital room, the patient is moved from the gurney to the hospital bed by medical staff, or the nursing staff.

The most common device used to move a patient is shown in FIG. 1. The transport device 100 includes a number of elongated rollers 110 that are covered by a mesh cloth or vinyl 130. A sheet of material, called a "chuck" 150, is wrapped around the device 100. The patient is rolled from a supine position to a lateral decubitus position (so called "log roll"), at which time the device is jammed between the patient and the surface of the bed or gurney or other surface on which the patient is lying. The patient is then rolled from the lateral decubitus position back to a supine position onto the device and the cloth chuck 150 covering the device 100. The patient is rolled onto the device 100 with the assistance of nursing or medical staff. At this point, the patient is generally only partially on the device 100. The medical or nursing staff may have to push and/or pull the patient across the device to effect a transfer across surfaces 100. Once on the transport device 100, the patient must be pushed and/or pulled across and over the device 100. The patient rolls over the transport device 100 and the individual rollers as the patient is transported to the next surface.

The current device has many problems. The ride for the patient is uncomfortable, as the dorsal aspect of the patient does not move smoothly across the belt surface due to the open spaces between the rollers, which are located beneath the belt. This bumpy ride is stressful on patients being transported. For example, patients that have just completed an operation are many times still being monitored during transport and into the recovery room. The monitoring information taken during transport, such as heart rate, ECG (electrocardiograph), blood pressure, and respiratory rate show that the patient undergoes stress. Another problem is related to the hospital staff, such as the nursing staff or medical staff. In moving the patient, the staff must bend over two surfaces and push and/or pull the patient. This method is inherently inefficient due to accepted principles of physics, i.e., friction. This can cause any number of injuries and resulting workman's compensation claims. Also, for patients of significant size and/or weight, additional hospital staff is required for the physical task of moving the patient from one surface to another with the existing transport device. These injury and labor force issues can add dramatically to the cost of operating a hospital. A new chuck has to be wrapped around the transportation device each time the patient is moved. Wrapping the transportation device with the chuck is mundane relative to the advancement of technology within the healthcare industry. These, of course, are but a few of the problems associated with the transportation device 100.

DETAILED DESCRIPTION

Figure 1:
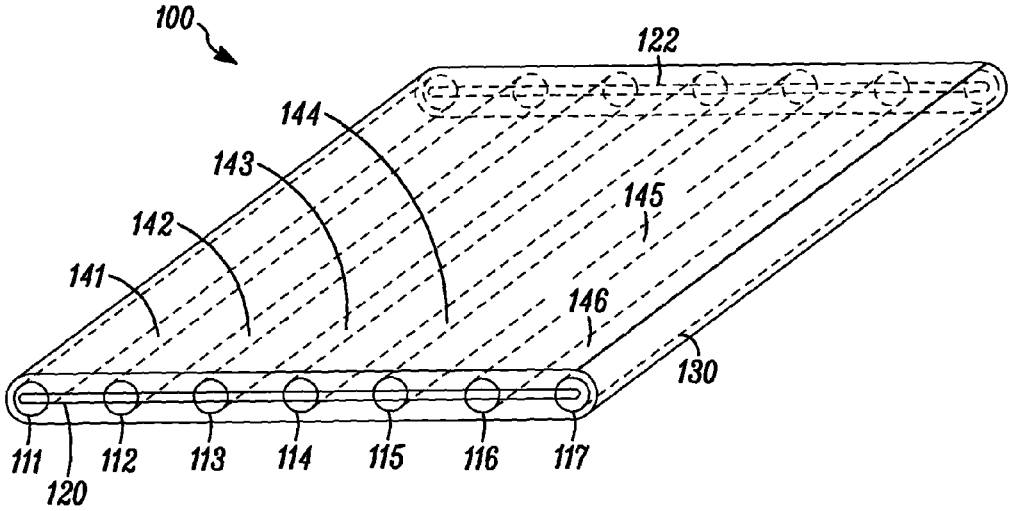
FIG. 1 is a perspective view of a prior art patient transportation device.

FIG. 1 is a perspective view of a prior art patient transportation device 100. The prior art patient transport device 100 includes a number of parallel spaced elongated rollers 111, 112, 113, 114, 115, 116, 117 which are spaced from one another. A frame member 120 and a frame member 122 hold the rollers in spaced relation to one another. The frame members 120, 122 are attached to the ends of the rollers 111, 112, 113, 114, 115, 116, 117. Each end of the roller 111, 112, 113, 114, 115, 116, 117 is rotatably attached to the frame member 120, 122. The frame members 120, 122 are tied to one another so as to form a substantially rigid frame. The rollers 111, 112, 113, 114, 115, 116, 117 are covered by a continuous belt 130. The continuous belt 130 is sized so that it fits tightly over the rollers 111, 112, 113, 114, 115, 116, 117. It should be noted that there are spaces 141, 142, 143, 144, 145, 146 between the rollers 111, 112, 113, 114, 115, 116, 117. In the spaces 141, 142, 143, 144, 145, 146 there is essentially no support. The continuous band 130 of the prior art is generally flexible. When supporting an object in the spaces 141, 142, 143, 144, 145, 146 between the rollers 111, 112, 113, 114, 115, 116, 117 the continuous band 130 flexes or sags. When an object is small it travels between a high position on top of a roller 111, 112, 113, 114, 115, 116, 117 and lower position in a space, such as spaces 141, 142, 143, 144, 145, 146 between the rollers 111, 112, 113, 114, 115, 116, 117. When a large flexible object is transported using the transport device, a flexible outside surface of the object will travel between these positions.

In some instances, a human being is transported using the prior art transport device 100. Human beings have an integumentary system. The integumentary system is the organ system that protects the body from damage, and includes the skin and its appendages (including hair, scales, feathers, and nails). The integumentary system has a variety of functions; such as to waterproof, to cushion, and to protect the deeper tissues, to excrete wastes, and to regulate temperature. The integumentary system is also the attachment site for sensory receptors to detect pain, sensation, pressure, and temperature. In humans, the integumentary system is the largest organ system.

When a human is the object being moved, first portions of the integumentary system are supported by the elongated rollers 111, 112, 113, 114, 115, 116, 117 while adjacent portions of the integumentary system are supported at lower positions by the belt 130, spanning spaces 141, 142, 143, 144, 145, 146 between the rollers 111, 112, 113, 114, 115, 116, 117. This is due to the flexible nature of skin in its function to cushion organs within the body. As a human is transported over the device 100, the skin or integumentary system undulates. This is stressful on the body. The stress occurs both when the human is conscious and unconscious. During surgery, the body is carefully monitored. The monitoring continues after surgery. For certain medical or surgical procedures, some patients require monitoring during transfer from the surgical surface to the transport surface. Other patients are also monitored as they convalesce in a post surgery recovery room. Monitoring information such as heart rate, ECG (electrocardiograph), blood pressure, and respiratory rate indicate that the patient undergoes stress during transfer.

In addition to producing stress, the transport device 100 also translates as the patient is moved. In other words, the elongated rollers 111, 112, 113, 114, 115, 116, 117 roll along the continuous belt 130 which, in turn, is rolled over the surfaces between which the patient is being transported. Such an arrangement can result in high localized loading at the rollers and may require more force to move a patient.

Figure 2:
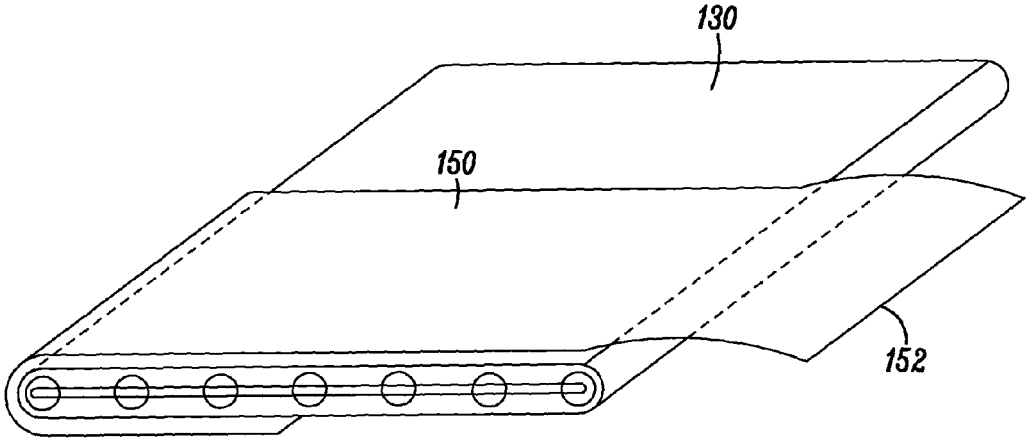
FIG. 2 is a perspective view of a prior art patient transportation device 100 with a chuck wrapped around the prior art patient transport device.

FIG. 2 is a perspective view of a prior art patient transportation device 100 with a chuck 150 wrapped around the patient transport device 100. In operation, a clean cloth, called a chuck 150, is wrapped around the patient transport device 100. The edge of the chuck 152 is generally gathered by workers on one side of the human. The chuck 150 is then pulled along the edge. Other workers can push the human to help move or transfer the patient from one surface to the other surface. Pushing the human adds to the stress. The workers generally must bend, push and pull and this causes the workers stress as well which can result in injury. At the end of its use, the chuck 150 is placed in the laundry, laundered and reused.

Figure 3:
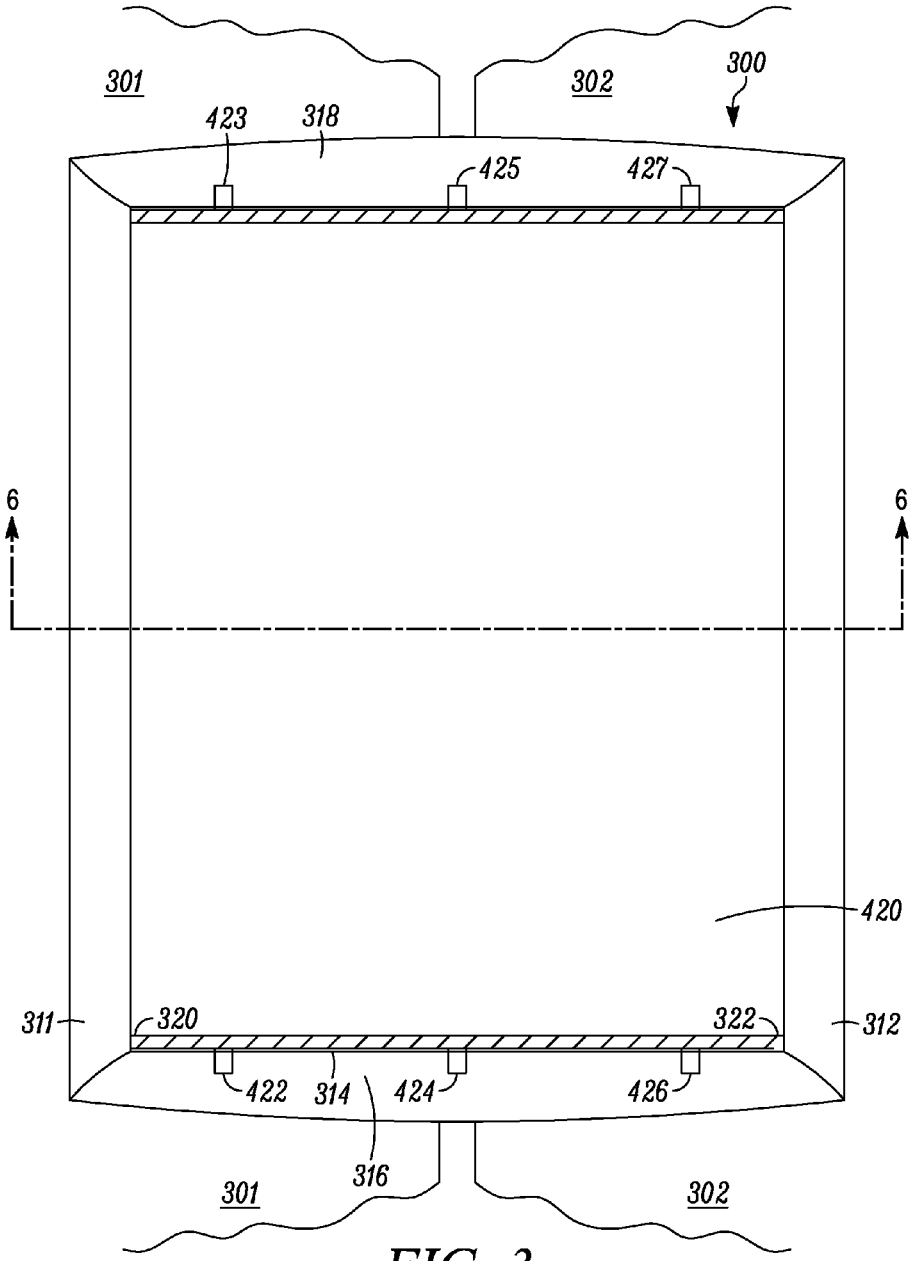
FIG. 3 is a top view of a patient transport system without a belt, as used to move a patient or object from a first surface to a second surface, according to an example embodiment.
Figure 4:
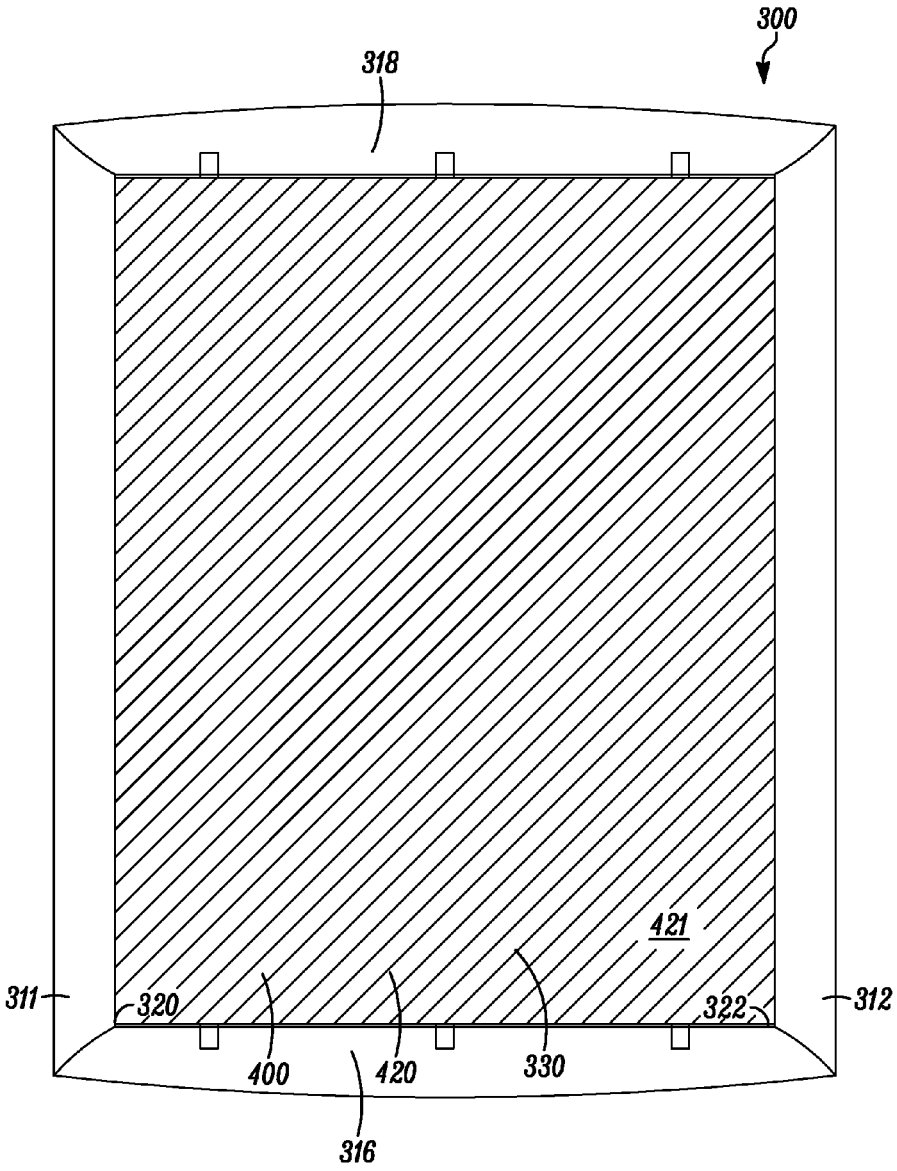
FIG. 4 is a top view of a patient transport system as used to move a patient or object from a first surface to a second surface with a continuous belt, according to an example embodiment.
Figure 5:
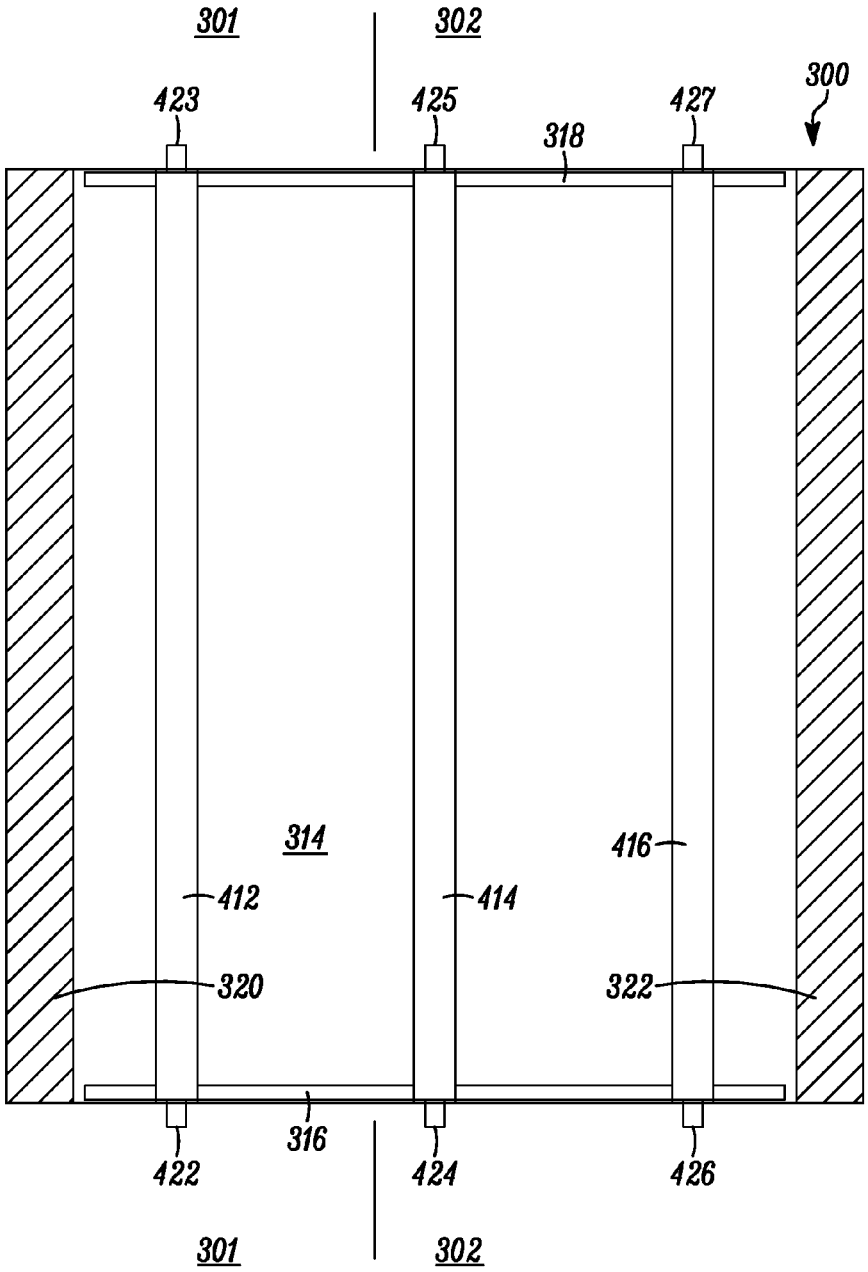
FIG. 5 is a top view of a patient transport system, with the continuous belt and a portion of the support system removed, according to an example embodiment.
Figure 6:
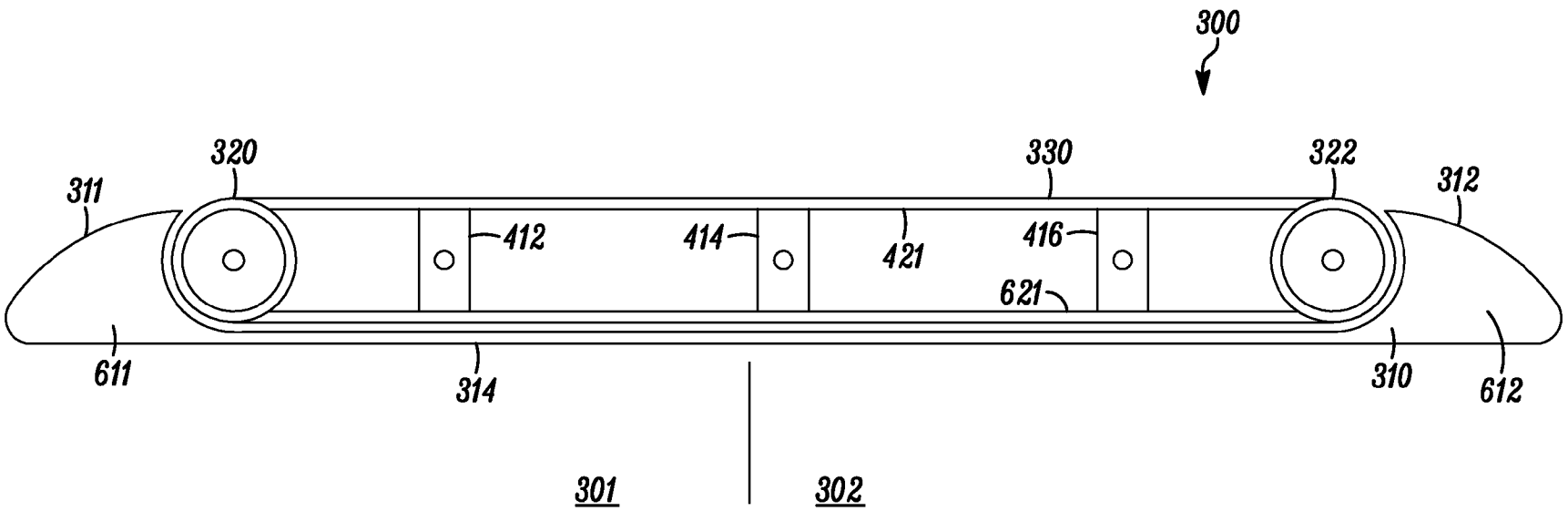
FIG. 6 is a cross-sectional view of a patient transport system, according to an example embodiment.

FIG. 3 is a top view of a patient transport system 300 as used to move a patient or object from a first surface 301 to a second surface 302, according to an example embodiment. FIG. 4 is a top view of a patient transport system 300 as used to move a patient or object from a first surface to a second surface with a continuous belt, according to an example embodiment. FIG. 5 is a top view of a patient transport system 300 as used to move a patient or object from a first surface 301 to a second surface 302, with both the continuous belt 330 and a portion of a support system 400 removed, according to an example embodiment. Specifically, the end caps and the side caps of the housing are removed from FIG. 5. The bridge cover material is also removed from FIG. 5. FIG. 6 is a cross sectional view of a patient transport system along line 5-5 in FIG. 3, according to an example embodiment. Now referring to FIGS. 3-6, the patient transport system 300 will be further detailed.

The patient transport system 300 includes a housing 310 dimensioned to span a distance between the first surface 301 and the second surface 302. The housing 310 is also made sufficiently strong so as to have the strength to not fail while spanning the distance. The patient transport system 300 includes a first elongated roller 320 positioned along a first edge or first side cap 311 of the housing 310; and a second elongated roller 322 positioned along a second edge or second side cap 312 of the housing 310. The patient transport system also includes a support system 400 (best seen in FIGS. 3 and 5). The support system 400 includes a set of individual supports 412, 414, 416 (shown in FIGS. 5 and 6). The individual supports 412, 414 416 are attached to the end caps 316, 318 of the housing 310. For example, individual support 412 is attached to housing end cap 316 at point 422 and to the housing end cap 318 at attachment point 423; and individual support 414 is attached to housing end cap 316 at point 424 and to the housing end cap 318 at attachment point 425; and individual support 416 is attached to housing end cap 316 at point 426 and to the housing end cap 318 at attachment point 427. A top bridge cover 421 is attached to the individual supports 412, 414, 416 to form a bridge 420. The bridge 420 can also have a bottom bridge cover 621 (shown in FIG. 6). The bridge covers 421, 621 are formed of a substantially rigid material, such as a low friction polymer or carbon fiber, plastic, metal or metal composite fiber material. The top bridge cover 421 flexes a limited amount during transport of an object, such as a patient, but is much more rigid than a belt material. The bridge 420 supports the object as it is transported using the patient transport system 300. When the object is a patient, the patient is supported so that the skin or the integumentary system undulates less than when the prior art device 100 is used. This reduces the stress placed on the patient when moved with the patient transport system 300 when compared to the prior art device 100. The bridge 420, in one embodiment, forms a support surface having a first portion which is substantially the same height as the first elongated roller 320 and a second portion which is substantially the same height as the second elongated roller 322.

The patient transport system 300 also includes a continuous belt 330. The continuous belt 330 is positioned in conveying relation with respect to the first roller 320 and the second roller 322 and with respect to the bridge 420. The first roller 320, the second roller 322, a major portion of the supports 412, 414, 416 and a major portion of the bridge 420 are positioned within the continuous belt 330. A portion of the continuous belt 330 conveys an object (not shown) while another portion of the continuous belt 330 passes through the housing 310. The housing 310 includes a bottom 314. The bottom 314 includes a first major surface abutting the first surface 301 and the second surface 302, and includes a second major surface on the inside of the housing. The continuous belt 330 does not touch the first surface 301 or second surface 302. The continuous belt 330 passes over the second major surface. In other words, the continuous belt passes over the top of the second major surface on the inside of the housing 310. The elongated rollers 320, 322 are positioned substantially within the housing 310 and above the second major surface of the bottom 314 of the housing 310. In another embodiment, the surface of the bridge 420 of the support system 400 is approximately the same height as one of the first end and the second end of the housing. The continuous belt passes over the support structure and specifically over the support surface as the continuous belt is moved to transfer an object. The support surface, in some embodiments, includes a material which lessens the friction occurring between the support surface and the belt.

Now looking at FIG. 6, in some example embodiments, the support structure 400 of patient transport system 300 also includes a bottom cover 621 attached to the supports 412, 414, 416. The cover 621 is also positioned within the housing 310. The cover 621 acts to guide the continuous belt 330. The cover 621 also prevents the continuous belt from catching on the supports 412, 414, 416. The support system 400 includes the bridge 420 which can be thought of as a frame covered by a bridge cover 421 and a bridge cover 621. In another embodiment, the support system could be formed of a solid material. In still other embodiments, the number of supports forming the frame could be varied. Furthermore, different types of materials could be used for the bridge cover 421 and the bridge cover 621. Bridge cover 421 is on one side of the supports 412, 414, 416 and bridge cover 621 is on the other side of the supports 412, 414, 416.

In one example embodiment, the continuous belt 330 is made of an elastomeric material so as to cushion an object to be transferred. The continuous belt 330 must be sufficiently thin so as to fit between the space between the roller 320 and the edge 311, and the space between the roller 322 and the edge 312 of the housing 310. The thickness of the belt 330 must allow the belt to flex. In other words, the belt material 330 must be sufficiently flexible so that it can wrap around the rollers 320, 322 and most of the support system 400. If the object is a human, the elastomeric material of the continuous belt 330 cushions the patient during a transfer. In another embodiment, a thinner cloth-like material is used in the continuous belt 330. It should be noted that any type of material that is sufficiently flexible and sufficiently thin to fit between a roller and an edge of the housing can be used.

When the continuous belt 330 is made of an elastomeric material it somewhat conforms to the object during transport. When the object to transfer is a human being or animal, the conformance of the belt provides some comfort to the animal or human being. The continuous belt must be sufficiently thin so as to remain clear of the housing during operation of the continuous belt. The continuous belt must also be sufficiently thin so as to allow the use of a chuck. If the continuous belt is too thick, the belt could become caught within the housing, for example. If the continuous belt is too thick, it may allow the continuous belt to be used but prevent operation of the device when a chuck is used. In one embodiment, the first and second elongated rollers 320, 322, respectively, are positioned inboard with respect to the first edge or side end cap 311 and the second edge or side end cap 312 of the housing 310.

In the embodiment shown in FIGS. 3-6, the first edge or side end cap 311 of the housing 310 includes a transition area 611 between a lower portion of the housing 310 and the support surface or surface of the bridge 420. The second edge or side end cap 312 of the housing 310 also includes a transition area 612 between a lower portion of the housing 310 and the support surface or surface of the bridge 420. The transition area can be made in any number of shapes. As best seen in FIG. 6, the first transition area 611 and the second transition area 612 are triangular in cross-sectional shape. The triangular-like shape allows the housing 310 of the system 300 to be placed near the object and slightly wedged into the space. The less slope between the edge or end caps 311, 312 of the housing 310 and the bottom of the housing 314, the gentler the transition area 611, 612. The transition area 611, 612 is generally longer with gentler slope. The transport device 300 will be wider with transition areas having a gentler slope. The width of the transport device 300 is one consideration in the design of the device. Other design considerations might be the comfort of a human, when the human is an object or the bulkiness of the device 300 when handled by hospital personnel in an operating suite or around the hospital.

Figure 18A:
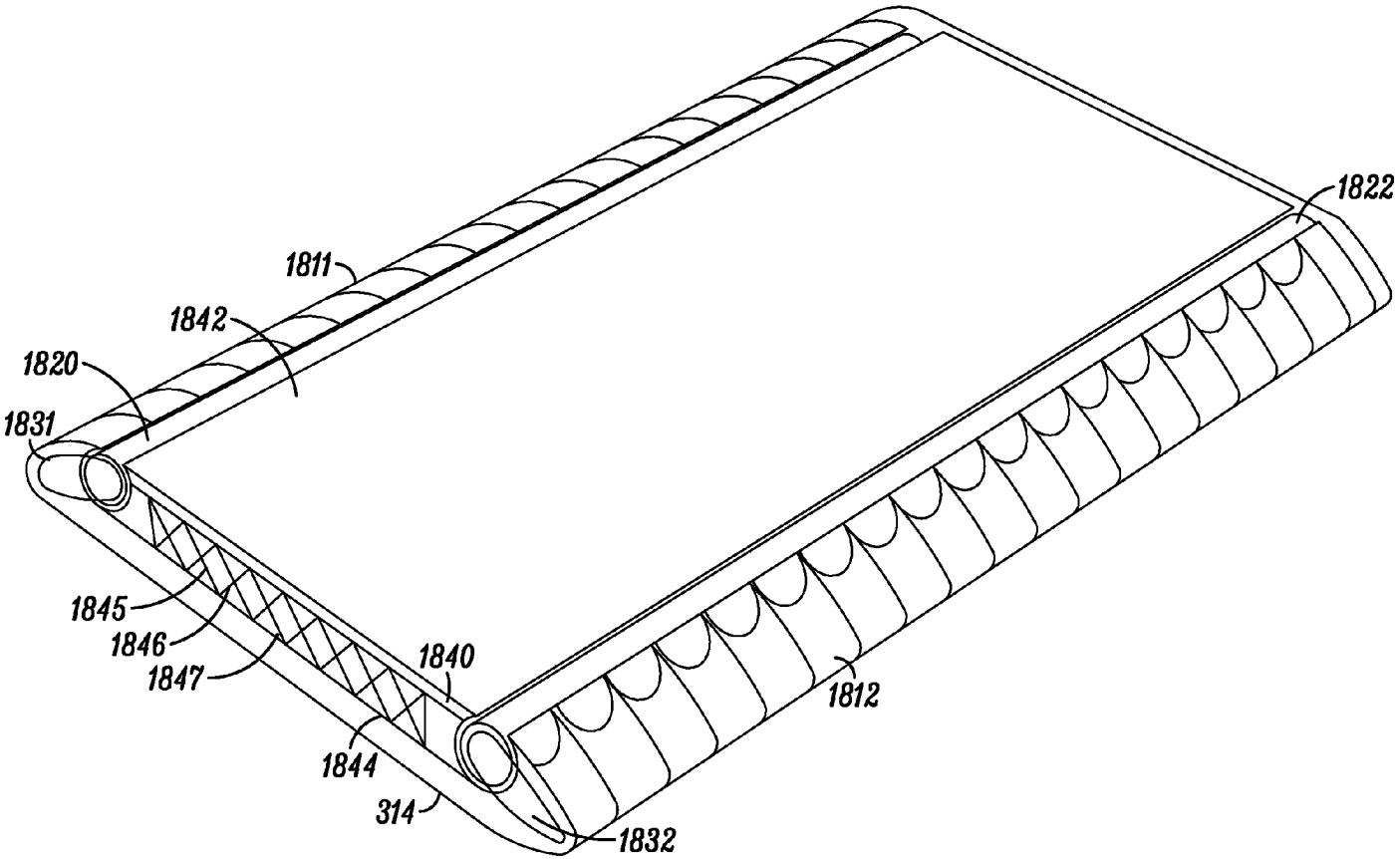
FIG. 18A shows a perspective blow up view of another example embodiment of the patient transport device.
Figure 18B:
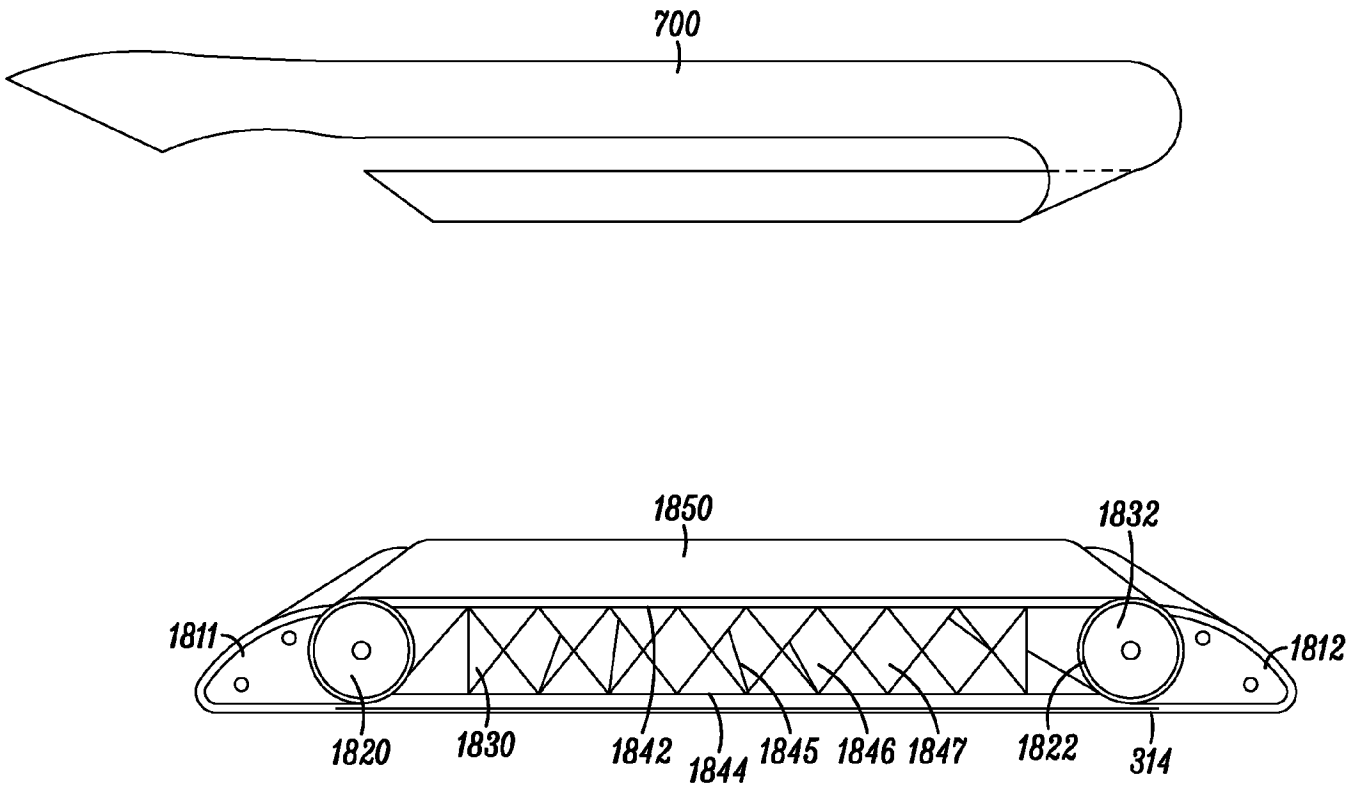
FIG. 18B shows an end view of another example embodiment of the patient transport device.
Figure 18C:
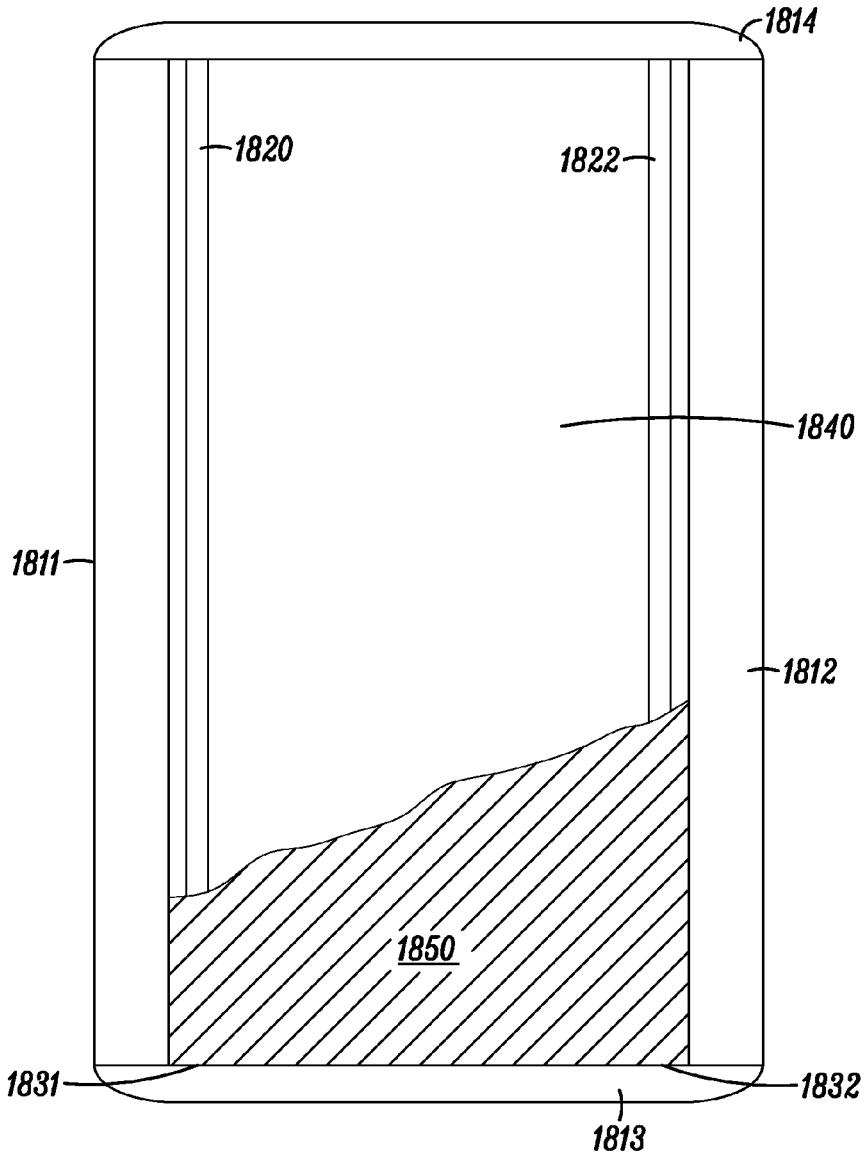
FIG. 18C shows a top view of another example embodiment of the patient transport device.

FIG. 18A shows a perspective blow up view of another example embodiment of the patient transport device 1800. FIG. 18B shows an end view of another example embodiment of the patient transport device 1800. FIG. 18C shows a top view of another example embodiment of the patient transport device 1800. Now referring to all of the FIGS. 18A, 18B, 18C, the patient transport device 1800 will be further detailed. The patient transport system 1800 includes a housing 1810 dimensioned to span a distance between the first surface and the second surface. The housing 1810 includes a first elongated frame member or side cap 1811, a second elongated frame member or side cap 1812, a first end cap 1813, and a second end cap 1814. The end caps 1813, 1814 attach to the first and second elongated frame members or side caps 1811, 1812 to form the housing 1810. The housing 1810 is made sufficiently strong so as to have the strength to not fail while spanning a distance somewhat shorter than the length of the end caps 1813, 1814. The housing 1810 holds a bridge 1840 which is formed from a material sufficiently strong to hold a patient. The bridge 1840 includes a top bridge cover 1842 and a bottom bridge cover 1844. Located between the top bridge cover 1842 and the bottom bridge cover 1844 are a plurality of truss members including truss members 1845, 1846, and 1847. In this example embodiment, the truss members are part of a matrix of truss members. The truss members provide strength without making the bridge 1840 overly heavy. The bridge 1840 can be made of metal, plastic, fiberglass or the like. The bridge 1840 can also be made of a composite of several materials or additional materials. It should be note that the side caps 1811 and 1812 also include a system of trusses, as shown in FIG. 18A. In another embodiment, the side caps 1811 and 1812 can be made of a solid material.

The patient transport system 1800 also includes a first elongated roller 1820 positioned along the first elongated frame member or first side cap 1811 of the housing 1810; and a second elongated roller 1822 positioned along the second elongated frame member or second side cap 1812 of the housing 1810. The patient transport system 1800 also includes a set of four connector plates. Two of the connector plates are shown in FIG. 18A as elements 1831 and 1832. These are most closely spaced with respect to the end cap 1813. It should be understood, that there are additional connector plates positioned near the end cap 1814. One connector plate 1831 is attached to one end of the side cap 1811 and another connector plate is attached to the other end of the side cap 1811. Similarly, there are two connector plates, including connector plate 1832, that are attached to the ends of the side cap 1812. The rollers 1820 and 1822 are rotatably attached to two connector plates. The end caps 1813 and 1814, in one embodiment, are also attached to the connector plates. For example, the end cap 1813 attaches to connector plates 1831 and 1832. The frame or housing 1810, the bridge 1840 and the connector plates form a support system 1830 for the patient transport system 1800. In one embodiment, the bridge 1840 attaches to the end caps 1813 and 1814. In another embodiment, the end caps 1813, 1814 include indents for receiving the end of the bridge. In this way, the bridge does not have to be connected by hardware but can merely slip into the openings or indents in the end caps 1813, 1814.

As shown in FIG. 18B, a continuous belt 1850 fits over the rollers 1820, 1822, the top bridge cover 1842, and the bottom bridge cover 1844. The continuous belt 1850 is positioned in conveying relation with respect to the first roller 1820 and the second roller 1822 and with respect to the bridge 1840. FIG. 18 B is an exploded view, so the belt is shown separate from the rollers 1820, 1822, the top bridge cover 1842, and the bottom bridge cover 1844. As shown in FIG. 18C, the first roller 1820, the second roller 1822, and the bridge 1840 are positioned within the continuous belt 1850. A portion of the continuous belt 1850 conveys an object (not shown) and while another portion of the continuous belt 1850 passes through the housing 1810. The continuous belt 1850 passes over the top bridge cover 1842, the bottom bridge cover 1844 of the bridge 1840, and the rollers 1820, 1822 while in the housing 1810. The continuous belt 1850 passes through the housing 1810 and does not contact the major surfaces that a patient is transferred from or to. The continuous belt 1850 passes over the support structure 1830 and specifically over the covers 1844, 1842 and the rollers as the continuous belt is moved to transfer an object. The material used to form the top bridge cover 1842 and the bottom bridge cover 1844, in some embodiments, includes a material which lessens the friction occurring between the covers 1842, 1844 and the belt 1850.

Now looking at FIG. 18B, the patient transport device 1800 is assembled and the end cap 1813 is removed to more clearly show the truss members of the bridge 1840 which are used to support the covers 1842, 1844. The truss members and covers are made of a material adequate to transport a patient. Of course a factor of safety can be incorporated into the design.

FIG. 18C shows a totally assembled patient transport device 1800. The continuous belt is cut away along the length so that the portions of the support systems 1830 are shown.

Figure 7:
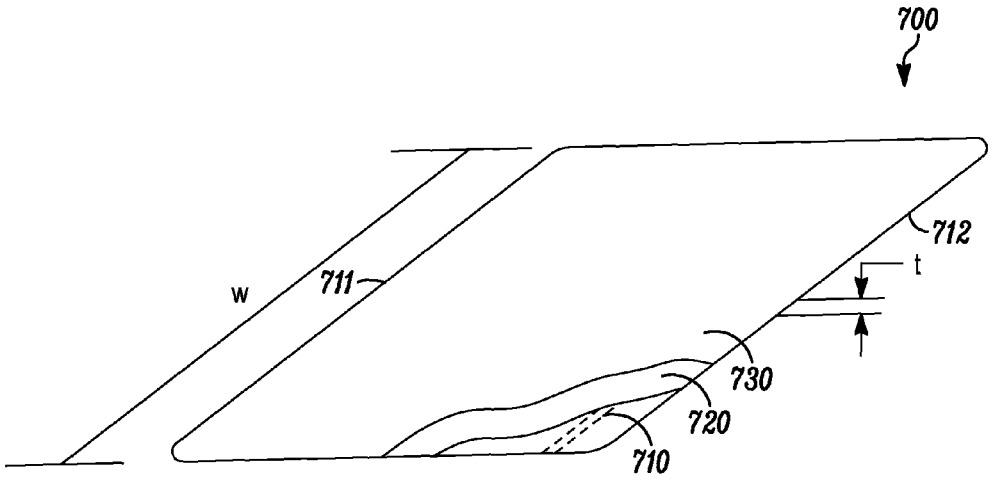
FIG. 7 shows a partially cut away perspective view of a disposable chuck, according to an example embodiment.
Figure 8:
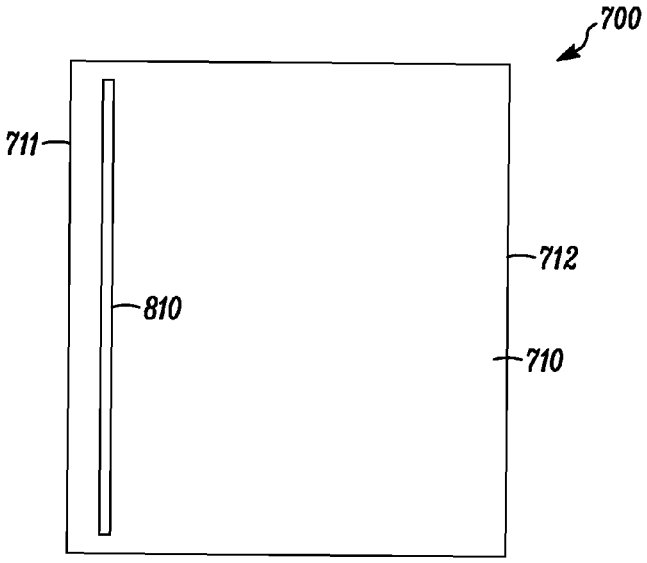
FIG. 8 shows a bottom view of the disposable chuck, according to an example embodiment.

FIG. 7 shows a partially cut away perspective view of a disposable chuck 700, according to an example embodiment. FIG. 8 shows a bottom view of the disposable chuck 700, according to an example embodiment. In operation a chuck 700 is used to provide additional cushioning and to provide a clean surface on which to transport an object. The chuck, in the embodiment shown, also may be disposable and includes absorbent material. In another embodiment, the chuck is formed from a permanent material and is adapted to receive an absorbent material. The absorbent material will absorb fluids that may be produced or come from an object, such as a patient. Any sort of absorbent material can be used. There are limits as to the thickness of the chuck 700. The chuck 700, when used, has to fit in a space between the outer surface of the continuous belt 330 when positioned on one of the rollers 320, 322 and the edge 311, 312 of the housing respectively. The thickness is denoted by the variable "t" shown in FIG. 7. The chuck 700 has a width, W. The width, W, is less than the width of the continuous belt 330. The width of the chuck 700 cannot be wider than the continuous belt 330 or the chuck 700 will bind the transport device 300. Looking at FIG. 7, the chuck 700 includes a bottom layer 710, an absorbent layer 720 and a top layer 730. The various layers 710, 720 and 730 are made of clean material. The various layers may also be made of a disposable material. The top layer 730 is permeable or will allow fluids to pass to the absorbent layer 720. The chuck 700 also includes a first edge 711 and a second edge 712. In one embodiment, the edges 711, 712 are perforated or have the earmarks from a perforated connection to another chuck. FIG. 8 shows that the bottom layer 710 includes an adhesive strip 810 toward one edge, such as edge 711 of the chuck 700. The adhesive strip 810 can be a single elongated strip or can be several smaller strips laid end to end to form an elongated adhesive strip near the edge 711. In another embodiment, the adhesive strip can be multiple strips or multiple elongated strips near one of the edges 711 of the chuck 700. In one embodiment, strips can be parallel to one another and parallel to the edge 711. The adhesive used is generally a releasable type of adhesive, such as an adhesive similar to that used on a Post-It® note from Minnesota Mining and Manufacturing of St. Paul, Minn. The releasable adhesive will allow the strip to be applied to a surface and removed without leaving an adhesive residue on the surface. In still another embodiment, the adhesive strip is covered with a strip of material to seal the adhesive until it is exposed for use. The material is of the peel and stick type. The chuck 700 can be bunched up along one of the edges 711, 712 and used to move an object such as a patient. In one embodiment, the chuck 700 can include hand hold openings.

Figure 19:
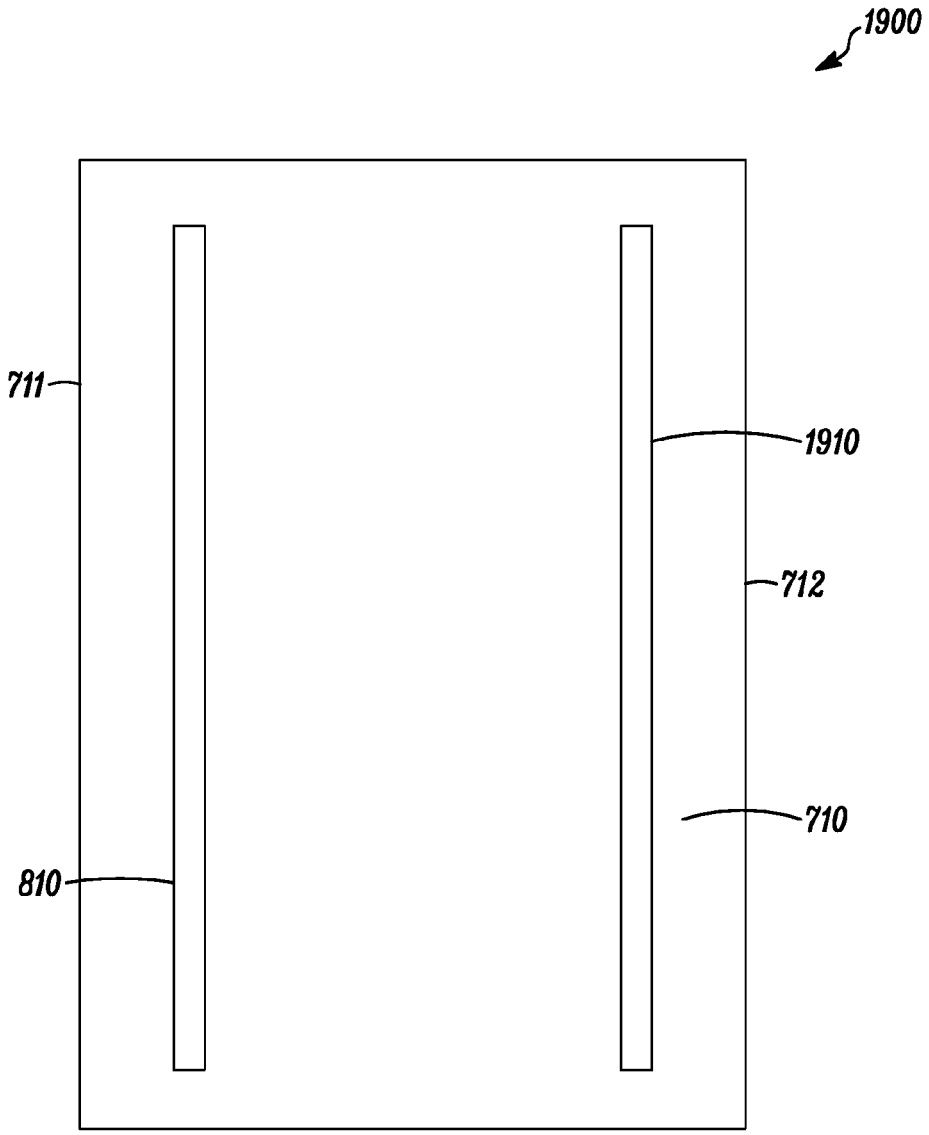
FIG. 19 shows a bottom view of the disposable chuck, according to another example embodiment.

FIG. 19 shows a bottom view of the disposable chuck 1900, according to another example embodiment. The disposable chuck 1900 is similar to the disposable chuck 700. Rather than repeat all the similarities, the following discussion will key in on the main differences between the disposable chuck 700 and the disposable chuck 1900. The chuck 1900 includes a second strip of adhesive 1910 that can be removed during the initial loading of the chuck 700 onto the patient transfer device or at a later time as needed. The second strip of adhesive may not be used at all by some.

Figure 9:
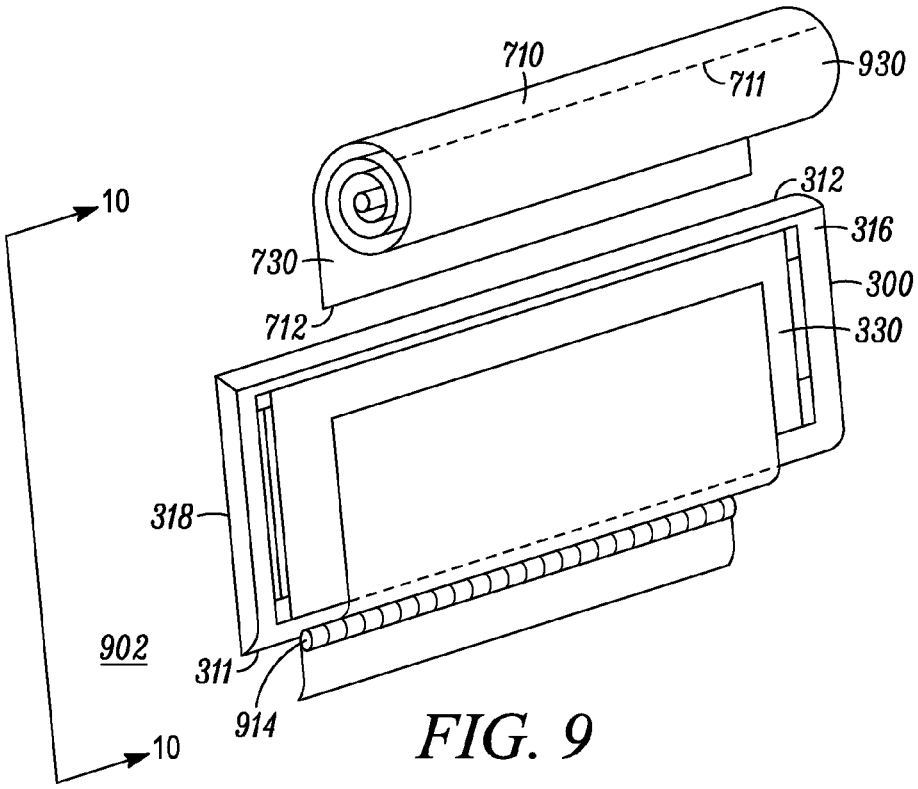
FIG. 9 shows a wall mounted bracket and roll of chucks, according to an example embodiment.
Figure 10:
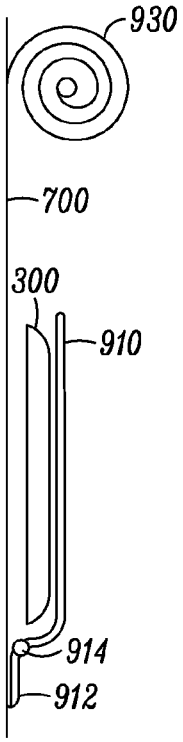
FIG. 10 is an end view of the wall mounted bracket for the patient transport device, and roll of chucks, according to an example embodiment.

FIG. 9 shows a wall mounted bracket 900 for the patient transport device 300, and roll 930 of chucks 700, according to an example embodiment. FIG. 10 is an end view of the wall mounted bracket 900 for the patient transport device 300, and roll 930 of chucks 700, according to an example embodiment. Now referring to both FIGS. 9 and 10, the details of the wall mount bracket and roll 930 of chucks 700 will be further detailed. The wall mount bracket 900 is attached or mounted to a substantially vertical surface, such as a wall 902. The wall mounted bracket 900 has an upper portion 910 and a lower portion 912. The upper portion 910 is substantially parallel with the lower portion 912. The lower portion 910 abuts the wall 902. The lower portion 912 is attached to the wall via any type of fastening device, such as lag bolts, screws, or the like. The lower portion 912 can be attached using an adhesive. In some embodiments, both an adhesive and one or more fasteners are used to attach the lower portion 912 of the wall bracket 900 to the wall 902. When attached, the upper end 910 is free and spaced from the wall at a distance which is greater than the width of the patient transport device 300. The patient transport device can then be stowed along the wall, and produce a minimal footprint. The patient transport device 300 also does not interfere with the ground. In many instances, the floor is kept clean so having the patient transport device off the floor is helpful in that it does not need to be moved to clean a room. The wall bracket 900 can be used in any type of room, including surgical suites, patient rooms, or hallways near a plurality of patient rooms. The device can also be used in transport vehicles, such as ambulances or helicopters, or rescue boats. Stored above the wall mounted bracket 900 is a roll of chucks 700. The chucks 700 are formed in a roll 930 and can be easily deployed. The patient transport device 300 is removed. A chuck is torn off the roll along a perforated edge, such as edge 712. The adhesive can then be used to removably attach the chuck 700 to the belt 330 of the transport device 300. Of course, in other embodiments, the chuck 700 may be attached to the patient transport device 300 before being removed from the storage spot of the wall mounted bracket 900. In one embodiment, the upper portion 910 is attached to the lower portion by a spring hinge 914. The spring hinge 914 allows the upper portion 910 to fold down and provide a substantially vertical working surface for the patient transport device 300 as a chuck is being loaded thereon. After the chuck 700 is loaded onto the patient transport device 300, the spring hinge 914 moves the upper portion 910 back to a position proximate the wall to which the wall bracket 900 is mounted. In still another embodiment, the roll of chucks can be placed or mounted in a housing. The housing can be attached to an appropriate surface. The housing protects the roll of chucks 700.

Figure 17:
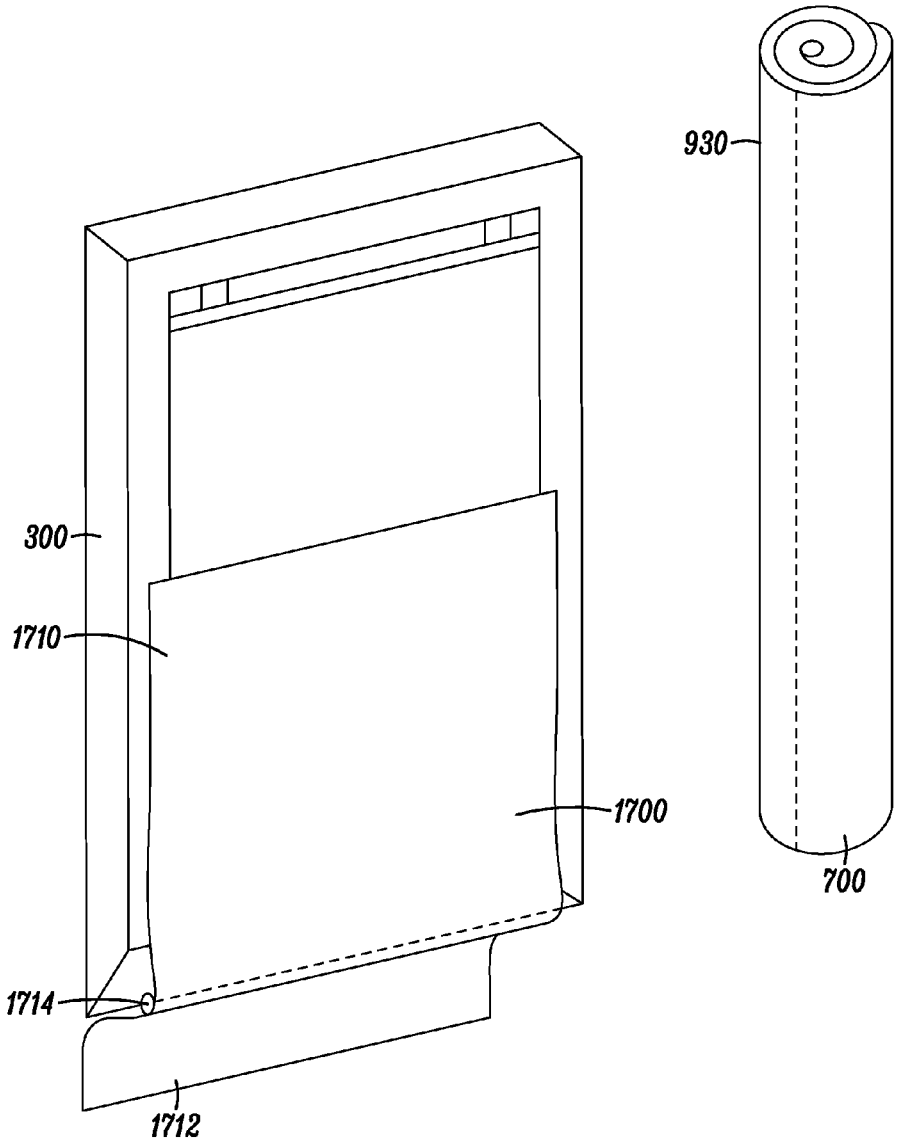
FIG. 17 shows another embodiment of a wall mounted bracket 1700 for the patient transport device, and roll of chucks, according to an example embodiment.

FIG. 17 shows another embodiment of a wall mounted bracket 1700 for the patient transport device 300, and roll 930 of chucks 700, according to an example embodiment. The wall mounted bracket 1700 is mounted in a vertical orientation. The space in an operating suite is precious. By orientating the wall mounted bracket 1700 vertically, there is less of a footprint with respect to the floor of the operating suite. In this manner, the wall mounted bracket 1700 would allow space for other equipment to be placed into the operating suite. In this embodiment, the roll 930 of chucks 700 is also mounted vertically. It should be realized that the roll 930 of chucks 700 could also be mounted horizontally. In fact, one of the wall bracket or roll could be mounted substantially horizontally and the other of the wall bracket or roll could be mounted substantially vertically in various example embodiments. In each of the various embodiments, the wall bracket 900, 1700 is provided with a set of contacts for a contact charger. The patient transport device 300 would have a corresponding set of contacts which make contact with the set of contacts associated with the device 300. The contacts would be used to recharge the motor inside the device 300. Similarly, the device 300 and the wall mounted brackets could also include a non-contact charging system which could be used to charge the motors associated with the device 300. In one embodiment, the non-contact charging device would include a set of coils associated with the patient transport device 300 and another set of coils associated with the wall bracket 1700. An alternating current passed through the coils in the wall bracket would induce an alternating current in the coils of the transport device. These could be rectified and used to charge a storage device, such as a battery. In such an embodiment, there would be no electrical contacts, which is advantageous if the operatory includes the use of combustible gases and the like. In another embodiment, the wall mounted bracket could be provided with electrical contacts that make contact with the patient transport device so that it is charged when placed in the wall mounted bracket 1700. The wall mounted bracket 1700 includes an upper portion 1710 and a lower portion 1712. In one embodiment, upper portion 1710 is attached to the lower portion 1712 by a spring hinge 1714. The spring hinge 1714 allows the upper portion 1710 to fold down and provide a substantially vertical working surface for the patient transport device 300 as a chuck is being loaded thereon. After the chuck 700 is loaded onto the patient transport device 300, the spring hinge 1714 moves the upper portion 1710 back to a position proximate the wall to which the wall bracket 1700 is mounted.

Figure 11:
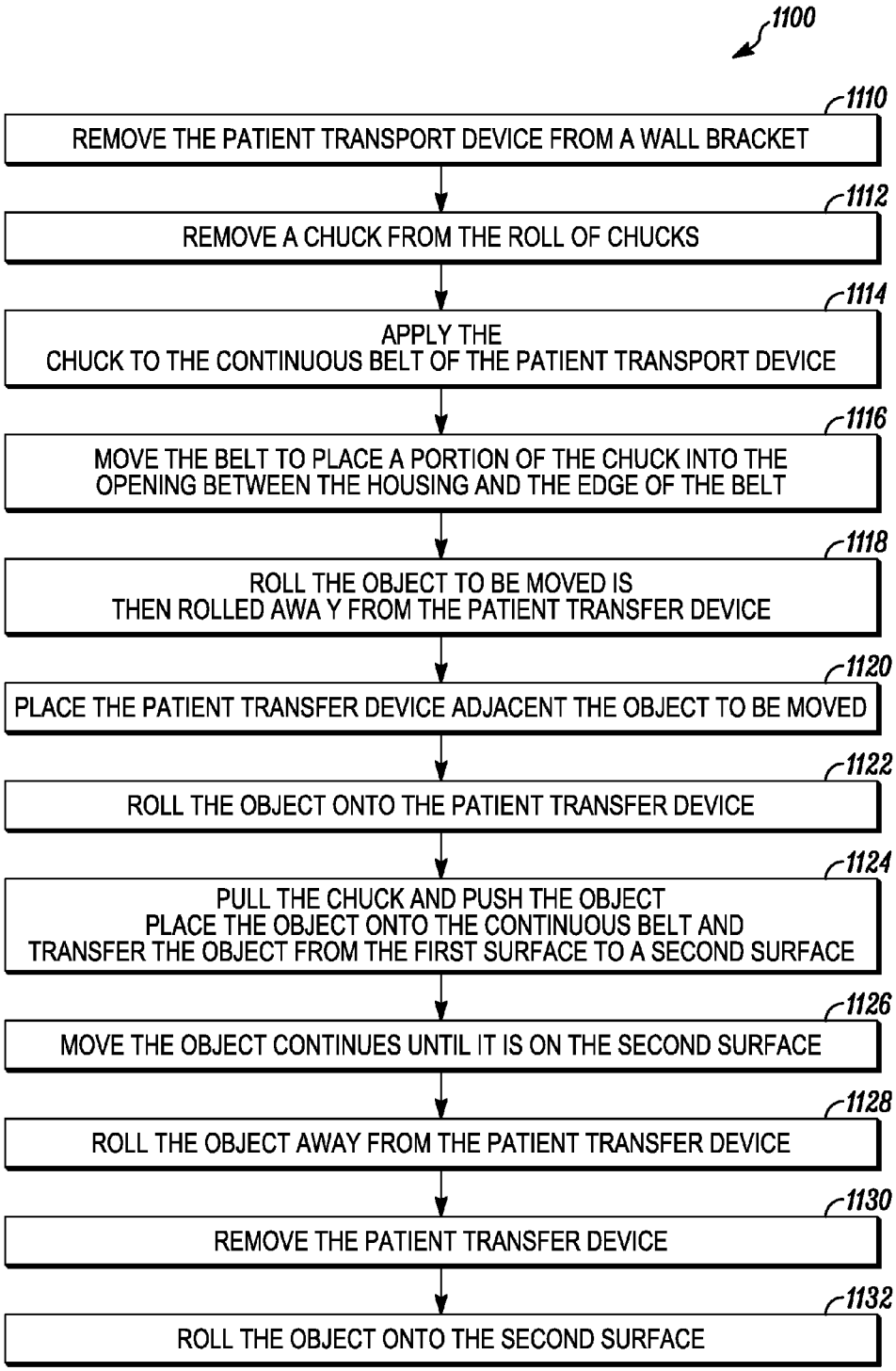
FIG. 11 shows a flow diagram of a method for operation of the patient transport device and chuck, according to an example embodiment.

FIG. 11 shows a flow diagram of a method 1100 for operation of the patient transport device and chuck, according to an example embodiment. The patient transport device 300 is removed from a wall bracket 1110, and a chuck 700 is removed from the roll of chucks 1112. The chuck 700 is applied to the continuous belt 330 of the patient transport device 1114. Applying the chuck to the continuous belt includes removing a peel and stick type covering from an adhesive strip, and placing the adhesive strip of the chuck onto the continuous belt of the patient transport device. Generally, the adhesive strip will be applied to the belt near the edge that will be initially placed under the patient. The belt is moved to place a portion of the chuck into the opening between the housing 310 and the edge of the belt 330, as depicted by 1116. This may be referred to as loading the chuck onto the patient transfer device, 1116. The object to be moved is then rolled away from the patient transfer device 1118, the patient transfer device is placed adjacent the object to be moved 1120, and the object is then rolled back onto the patient transfer device 1122. The object, such as a patient, is now partially on the patient transfer device. The chuck can then be pulled and the object pushed to place the object onto the continuous belt and transfer the object from the first surface to a second surface, 1124. At least one portion of the chuck contacts the continuous belt. The object continues to be moved until it is on the second surface 1126. The object can then be tilted or rolled away from the patient transfer device 1128, and the patient transfer device can then be removed 1130 and the object can be rolled onto the second surface 1132.

Figure 12:
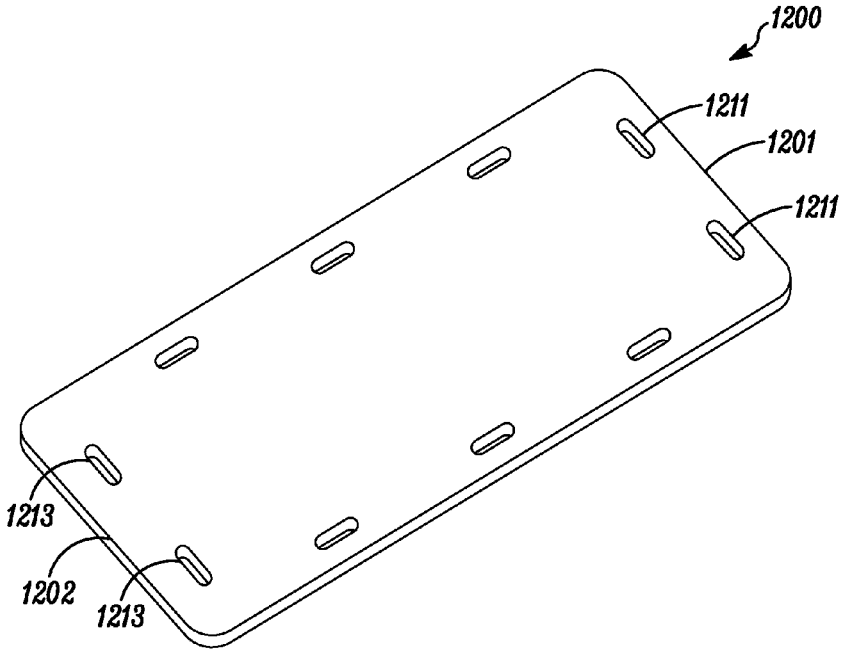
FIG. 12 shows a supplement sheet 1200 that can be used to add strength to the chuck 700 during a patient transfer, according to an example embodiment.

FIG. 12 shows a supplement sheet 1200 that can be used to add strength to the chuck 700 during a patient transfer, according to an example embodiment. When the object is heavy or above a certain weight, there is a possibility that the chuck 700 may not hold up to the pulling forces needed to move the object. As a result, a sheet 1200 of a thicker and stronger material supplements and adds to the system. As shown, the sheet is a relatively thin and tough plastic sheet that is dimensioned so that it fits on the continuous belt 330, 1850. In operation, the sheet 1200 fits between the chuck 700 and the continuous belt 330, 1850. The sheet is positioned there when it is determined that the object, such as a heavy patient, may be large enough so that pulling on the chuck 700 alone may rip the chuck 700. The sheet 1200 is made of a tough plastic that can be grabbed and moved with little chance of tearing. In one example embodiment, the sheet 1200 is made of polyethelene having a thickness of approximately 20 mils. As shown, the sheet 1200 has a first edge 1201 and a second edge 1202. The sheet 1200 can have a first set of handholds 1211 positioned near the first edge 1201 and a second set of handholds 1213 is near the second edge 1202. In another embodiment, the sheet can include a foam material. The foam material provides for further cushioning of the object during transport. In some embodiments, the foam is added to the sheet 1200 to provide a composite sheet that is both strong and cushioned. In another embodiment, the sheet may be entirely made of foam material.

Figure 13:
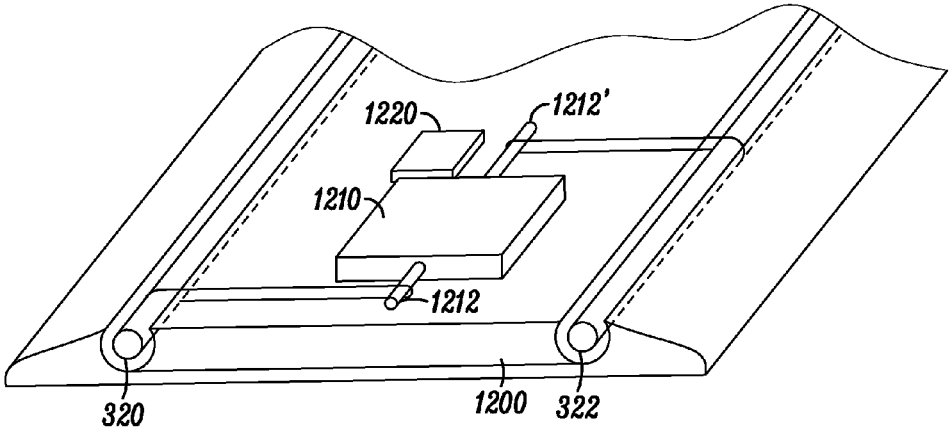
FIG. 13 shows a schematic view of a transport device with a drive system, according to an example embodiment.

In some embodiments, the patient transport device 300 includes a drive mechanism 1210. FIG. 13 shows a schematic view of a transport device 1200 with a drive system 1210, according to an example embodiment. The drive mechanism, in one embodiment, includes an electric motor 1210, such as a brushless induction motor. The electric motor turns a shaft 1212 and 1212' which is coupled to at least one of the elongated rollers 320, 322. The shaft 1212, 1212' turns and drives the rollers 320, 322. The shaft 1212, 1212' turns one way to rotate the roller in a first direction and turns another way to turn the roller in the opposite direction. In one embodiment, the shafts 1212, 1212' are connected so that the rollers 320, 322 can be rotated freely to override the drive motor 1210. In one embodiment, the motor 1210 includes a gearbox having a set of pawls that are used to drive the shaft in a first direction. If the rollers are turned faster than the driven speed, the pawls merely ride over an adjacent drive position to allow the rollers to free wheel in the driven direction. This is helpful in the event the drive mechanism is not moving fast enough and the people overseeing the transfer of the object want to expedite the transfer, such as in an emergency situation. In addition, if there is a loss of power, it is necessary in order to move the object. As discussed above, the patient transport device is bi-directional because the shafts 1212, 1212' can be driven in a first direction and in a second direction. Of course, the second direction may be the reverse or opposite the first direction. It is contemplated that sensors could be used to automatically determine which way to drive the rollers. In one embodiment, accelerometers are used to detect tilt and to detect which of the sides of the patient transport device 300 contacts a surface first. This will generally indicate the side of the patient transport device 300 that is placed under the patient. In another embodiment, each edge of the patient transport device 300 is provided with a stress or strain gauge. The stress or strain gauge can be used to detect a force, such as a partial weight of a patient on one edge of the patient transport device. In either embodiment, detecting the patient using a strain gauge or by detecting the tilt of the device 300, the top surface or exterior portion of the continuous belt is driven away from the patient so as to move the patient to a position on the surface of the device 300. In some embodiments, inertial activation is used to determine the direction to drive the belt. It should be noted that one or more of these types of sensors can be combined to form a more robust system.

In one embodiment, the electric motor is powered by a battery. In one example embodiment, the wall bracket can include a charger that charges the battery by induction technology. Of course, the motor within the patient transfer device 1200 is an induction motor. The charger is within the wall bracket 900 and is positioned in charging relation to the motor within the patient transfer device 1200. Induction contact points are located within the patient transfer device. The battery within the patient transfer device 1200 is then charged whenever the patient transfer device is placed in the wall mounted bracket 900. Therefore, the battery 1220 will be charged and ready when the patient transfer device is needed. After use, the patient transfer device 1200 is placed in the wall mount bracket and recharged again. In another embodiment, the charger can also be placed in the wall near the wall bracket. In still other embodiments, the wall bracket 900 includes a series of stops to correctly position the patient transfer device with respect to the wall bracket so that the charger within the wall bracket is able to charge the battery 1220.

Figure 14:
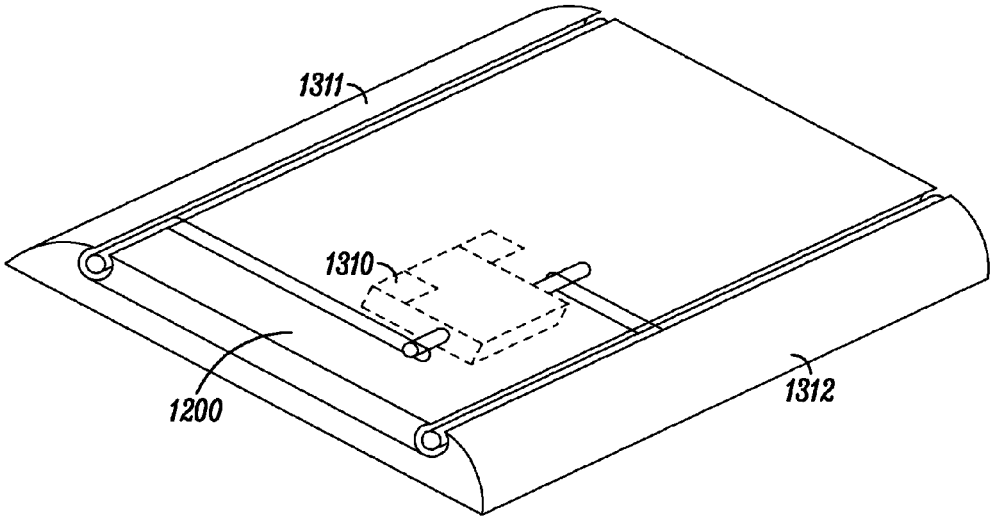
FIG. 14 is a schematic of a control system that acts in response to a set of sensors associated with the transport device 1200, according to an example embodiment.

FIG. 14 is a schematic of a control system that acts in response to a set of sensors associated with the transport device 1200, according to an example embodiment. The patient transport device 1200 includes a controller 1310 for controlling the electric motor 1210 used to drive the patient transfer device 1200. The patient transfer device 1200 also includes sensors, such as a sensor 1311 and a sensor 1312. Sensor 1311 is associated or positioned on or within a first edge of the housing of the patient transfer device. Sensor 1312 is associated or positioned on or within a second edge of the housing of the patient transfer device 1200. The sensors 1311, 1312 are used to detect the position of an object to be transported. The sensors 1311, 1312 can be any type of sensor including an optical sensor, a heat sensor, a gyroscopic sensor, an inertia sensor, or a strain gauge, or the like. An optical sensor detects an object in response to a reduced amount of light occurring at one sensor when compared to another optical sensor. A strain gauge will detect weight added to the housing in the area of the sensor location. A heat sensor could sense heat of an object, should the object moved be a human being for example. A gyroscopic sensor senses the axis plane position of a portion of the patient transport device 1200. The inertia sensor senses the commencement of movement or the stoppage of movement. The sensors 1311 and 1312 can be used to control movement or driving of the continuous belt 330 so as to make the patient transport device user-friendly to hospital personnel using the device to transport a patient. Of course, more than two sensors can be used in other embodiments.

Figure 15:
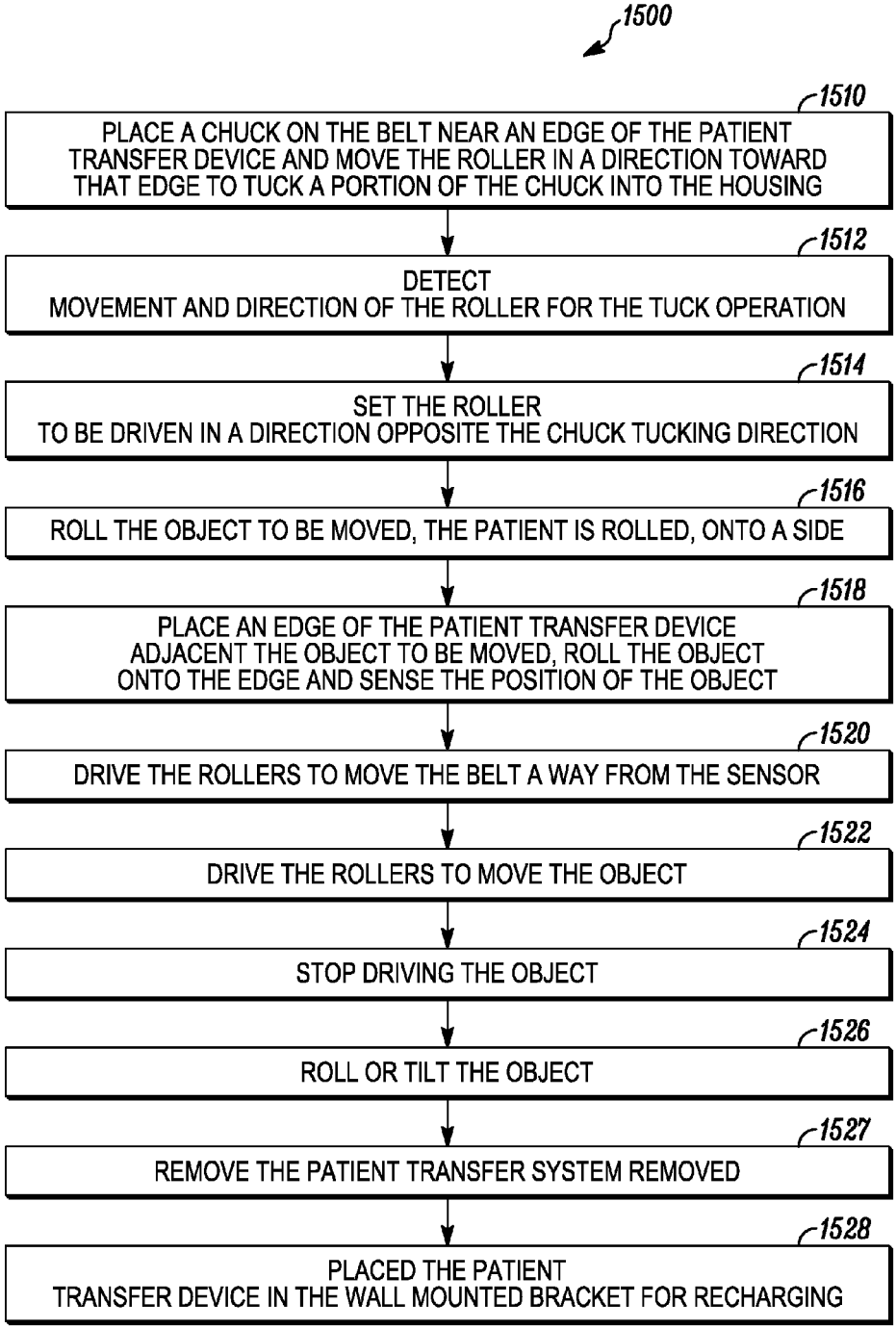
FIG. 15 is a flow diagram for a method for controlling the movement of a belt and for driving the belt, according to an example embodiment.

FIG. 15 is a flow diagram for a method 1500 for controlling the movement of a belt and for driving the belt, according to an example embodiment. If a chuck 700 is placed on the belt near an edge, the roller will be turned in a direction toward that edge so as to tuck the chuck 700 into the housing 1510. The controller 700 could detect movement and direction of the roller for this operation 1512 and set the roller to be driven in a direction opposite the chuck tucking direction 1514. To ease the discussion, assume that the edge carrying the sensor 1311 is going to be the edge initially placed near the object to be moved. The object is typically rolled away from the edge. For example, if a patient is the object to be moved, the patient is rolled onto his or her side 1516. The edge is placed adjacent the object to be moved, and then rolled onto the edge and over the sensor 1311. The position of the patient is sensed 1518. If sensor 1311 is a light sensor, a signal indicating a lack of light or sudden drop in an amount of light is sent to the controller 1310. The controller 1310 could then drive the rollers to move the belt 330 away from the sensor 1311, as depicted by reference number 1520. In some embodiments, the controller might have to detect a lack of light for a set time before actually moving. This would prevent detecting an object when there actually was not such an object (such as a user placing a hand on the sensor 1311). In one embodiment, the sensor 1311 can be compared to the sensor 1312. If the two detect equal levels of light, the room would just be dark. In another embodiment, the sensor could be a stress/strain gauge. When an object is rolled onto the edge containing the sensor 1311, the stress/strain gauge would detect added weight on the frame or the portion of the frame near the sensor 1311. The sensor 1311 could also detect heat or a warm object to determine that an object is on the frame. Once an object has been detected, the drive system 1210 drives the rollers away from the edge with the sensor 1311. The drive system 1210 will drive the rollers to move the object 1522 and then stop driving the object 1524. There are many options for stopping the rollers. For example, in one embodiment, the drive system 1210 will drive the rollers to move the object until the sensor 1312 detects the object by way of a lack of light, an increase in weight, or by sensing heat at the sensor 1312. In one embodiment, the drive system 1210 can continue to drive the belt for a set amount of time or for a set distance. In still another embodiment, the belt can be driven until a lack of weight, increased light or heat is no longer sensed at the sensor 1312. In still another embodiment, the driver 1210 will stop when the load need to drive the belt increases, which indicates that the object traveled to the second surface and is now resting in part on the second surface. The horizontal component of force needed to overcome friction on the second surface will cause the load on the motor to go high. The motor associated with the drive system can then be stopped. The object can be rolled or tilted 1526 and the patient transfer system removed 1527 and placed back in the wall mounted bracket for recharging 1528.

Discussed above is one control method. It should be noted that other control methods are possible. For example, a sensor able to detect a level surface might be used. The patient transfer device could be placed on the first and second surface and be substantially level. The chuck 700 could be attached to the belt. When the patient or object is rolled onto their side, the patient transfer device is typically tilted slightly with the low end being nearest the patient or object. Sensing the tilt toward an edge could be a signal to drive the roller in a direction toward the patient to load the chuck 700. The remaining portion of the control method discussed above could then be carried out as discussed above.

Described above is a system that would work with a few sensors. It is contemplated that other sensors could be used and produce inputs to a controller to enhance the ease of use for hospital personnel or others that use the patient transfer system. For example, gyroscopic technology can also be used to sense certain conditions. A gyroscopic sensor can be used to detect a substantially level condition, such as when the patient transfer device is placed between a first surface and a second surface. Once the level condition is detected, the drive system can be enabled or turned on and readied for use. Using gyroscopic technology, the device can also be disabled or turned off when it is determined to be at an angle greater than a selected threshold, such as 30 degrees with respect to level or horizontal. Levels can also be used to produce inputs for enabling and disabling the device. A sensor could also provide an input to automatically shut off the device when it is within the wall mounted bracket.

Figure 16:
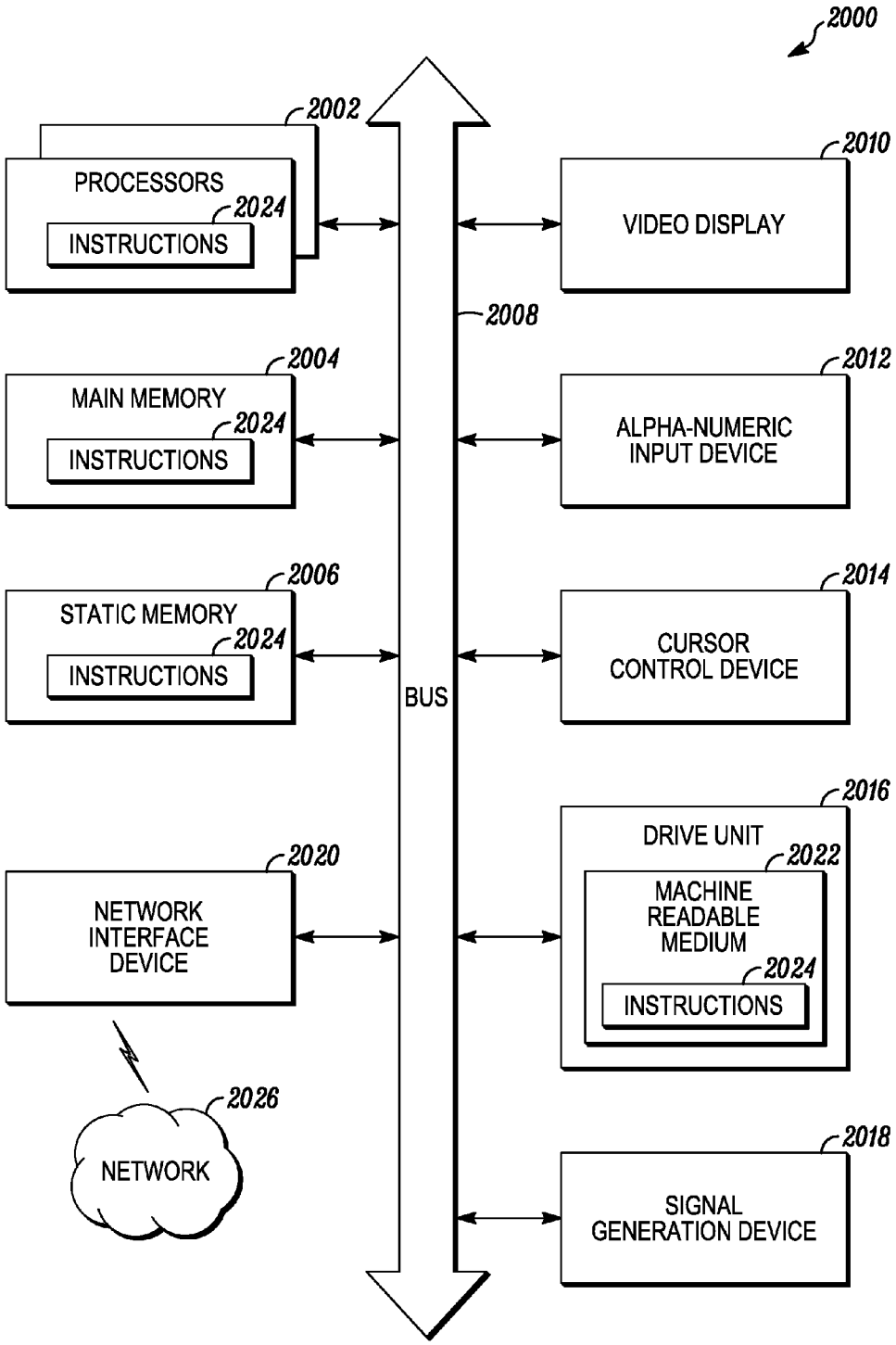
FIG. 16 shows a diagrammatic representation of a computing device for a machine in the example electronic form of a computer system, within which a set of instructions for causing the machine to perform the methods discussed above, according to an example embodiment.

FIG. 16 shows a diagrammatic representation of a computing device for a machine in the example electronic form of a computer system 2000, within which a set of instructions for causing the machine to perform the methods discussed above, according to an example embodiment. In various example embodiments, the machine operates as a standalone device or can be connected (e.g., networked) to other machines. In a networked deployment, the machine can operate in the capacity of a server or a client machine in a server-client network environment, or as a peer machine in a peer-to-peer (or distributed) network environment. The machine can be a personal computer (PC), a tablet PC, a set-top box (STB), a Personal Digital Assistant (PDA), a cellular telephone, a portable music player (e.g., a portable hard drive audio device such as an Moving Picture Experts Group Audio Layer 3 (MP3) player), a web appliance, a network router, a switch, a bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 2000 includes a processor or multiple processors 2002 (e.g., a central processing unit (CPU), a graphics processing unit (GPU), arithmetic logic unit or all), and a main memory 2004 and a static memory 2006, which communicate with each other via a bus 2008. The computer system 2000 can further include a video display unit 2010 (e.g., a liquid crystal displays (LCD) or a cathode ray tube (CRT)). The computer system 2000 also includes an alphanumeric input device 2012 (e.g., a keyboard), a cursor control device 2014 (e.g., a mouse), a disk drive unit 2016, a signal generation device 2018 (e.g., a speaker) and a network interface device 2020.

The disk drive unit 2016 includes a computer-readable medium 2022 on which is stored one or more sets of instructions and data structures (e.g., instructions 2024) embodying or utilized by any one or more of the methodologies or functions described herein. The instructions 2024 can also reside, completely or at least partially, within the main memory 2004 and/or within the processors 2002 during execution thereof by the computer system 2000. The main memory 2004 and the processors 2002 also constitute machine-readable media.

The instructions 2024 can further be transmitted or received over a network 2026 via the network interface device 2020 utilizing any one of a number of well-known transfer protocols (e.g., Hyper Text Transfer Protocol (HTTP), CAN, Serial, or Modbus). For example, it is contemplated that an application, referred to as an app, could be used with a handheld device, such as an iPhone® available from Apple Computer and various wireless telephone carriers, could be employed as an interface for controlling the patient transfer device. Other smart phones could also be provided with applications that could be used to control the patient transfer device. For example, a mobile phone application could be used to enable or turn on the device and issue certain commands needed to move an object. In essence, an application could be used to convert a mobile phone or smart phone into a remote. Of course, a dedicated remote could also be provided with the patient transport device. While the computer-readable medium 2022 is shown in an example embodiment to be a single medium, the term "computer-readable medium" should be taken to include a single medium or multiple media (e.g., a centralized or distributed database, and/or associated caches and servers) that store the one or more sets of instructions and provide the instructions in a computer readable form. The term "computer-readable medium" shall also be taken to include any medium that is capable of storing, encoding, or carrying a set of instructions for execution by the machine and that causes the machine to perform any one or more of the methodologies of the present application, or that is capable of storing, encoding, or carrying data structures utilized by or associated with such a set of instructions. The term "computer-readable medium" shall accordingly be taken to include, but not be limited to, solid-state memories, optical and magnetic media, tangible forms and signals that can be read or sensed by a computer. Such media can also include, without limitation, hard disks, floppy disks, flash memory cards, digital video disks, random access memory (RAMs), read only memory (ROMs), and the like. The computer system or part of a computer system could be used as the controller 1310 in the drive system of the patient transfer device. In addition, the patient drive system could be provided with any type of link for receiving signals over a link, such as an internet link, RF link, infrared link or the like.

The example embodiments described herein can be implemented in an operating environment comprising computer-executable instructions (e.g., software) installed on a computer, in hardware, or in a combination of software and hardware. Modules as used herein can be hardware or hardware including circuitry to execute instructions. The computer-executable instructions can be written in a computer programming language or can be embodied in firmware logic. If written in a programming language conforming to a recognized standard, such instructions can be executed on a variety of hardware platforms and for interfaces to a variety of operating systems. Although not limited thereto, computer software programs for implementing the present method(s) can be written in any number of suitable programming languages such as, for example, Hyper Text Markup Language (HTML), Dynamic HTML, Extensible Markup Language (XML), Extensible Stylesheet Language (XSL), Document Style Semantics and Specification Language (DSSSL), Cascading Style Sheets (CSS), Synchronized Multimedia Integration Language (SMIL), Wireless Markup Language (WML), Java™, Jini™, C, C++, Perl, UNIX Shell, Visual Basic or Visual Basic Script, Virtual Reality Markup Language (VRML), ColdFusion™ or other compilers, assemblers, interpreters or other computer languages or platforms.

This has been a detailed description of some exemplary embodiments of the invention(s) contained within the disclosed subject matter. Such invention(s) may be referred to, individually and/or collectively, herein by the term "invention" merely for convenience and without intending to limit the scope of this application to any single invention or inventive concept if more than one is in fact disclosed. The detailed description refers to the accompanying drawings that form a part hereof and which shows by way of illustration, but not of limitation, some specific embodiments of the invention, including a preferred embodiment. These embodiments are described in sufficient detail to enable those of ordinary skill in the art to understand and implement the inventive subject matter. Other embodiments may be utilized and changes may be made without departing from the scope of the inventive subject matter. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed:

1. A system configured for transferring a patient from a first surface to a second surface, the system comprising:

a housing dimensioned to span a distance between the first surface at a first side of the housing and the second surface at a second side of the housing, the housing including:

a first end and a second end, each of the first and second ends dimensioned to span the distance between the first surface at the first side of the housing and the second surface at the second side of the housing;

a first elongated frame member forming the first side of the housing; and a second elongated frame member forming the second side of the housing;

wherein the first and second ends attach to the first and second elongated frame members to form the housing;

a continuous belt positioned in conveying relation with respect to a bridge positioned within the continuous belt and configured for a portion of the continuous belt to convey the patient while another portion of the continuous belt passes through the housing, wherein the bridge is further configured to support the patient and the continuous belt does not touch the first surface or the second surface;

a disposable sheet removably attached to the continuous belt and having a portion inserted into an opening between the continuous belt and the housing, wherein the disposable sheet is configured to be pulled in order to transfer the patient from the first surface to the second surface; and a support structure comprising the bridge positioned within the continuous belt and connected to the first end and the second end of the housing, the bridge configured to support the patient as the patient is transferred from the first surface to the second surface.

2. The system of claim 1, further comprising first and second rollers positioned along the elongated frame members, wherein the continuous belt is positioned in conveying relation with respect to the first and second rollers and the support structure includes a support surface having a first portion which is substantially a same height as the first roller.

3. The system of claim 2, wherein the support surface has a second portion which is substantially a same height as the second roller.

4. The system of claim 1, wherein the bridge of the support structure includes a support surface, the continuous belt configured to passover the support surface as the continuous belt is moved in a configuration to transfer the patient, the support surface formed of a material to reduce friction between the support surface and the continuous belt.

5. The system of claim 1, wherein the bridge of the support structure includes a support surface, the continuous belt configured for passing over the support surface as the continuous belt is moved in a configuration to transfer the patient, the continuous belt formed of an elastomeric material.

6. The system of claim 1, wherein the first side of the housing includes a transition area between a lower portion of the housing and a support surface of the bridge and the second side of the housing includes a transition area between the lower portion of the housing and the support surface of the bridge.

7. The system of claim 6, wherein the transition areas between the lower portion of the housing and the support surface of the bridge are triangular in cross sectional shape.

8. The system of claim 1, further comprising a drive system for driving the continuous belt.

9. The system of claim 8, further comprising a control system operatively coupled to the drive system.

10. The system of claim 9, further comprising:

a first sensor configured for detecting a first position of the patient; and a second sensor configured for detecting a second position of the patient, the first and second sensors operatively coupled to the control system;

wherein the control system enables and disables the drive system based on the first and second sensors detecting the first and second positions of the patient being transferred from the first surface to the second surface.

11. The system of claim 1, wherein the disposable sheet comprises a disposable chuck removably attached to the continuous belt and configured for transferring the patient by pulling on the disposable chuck to position the patient on the continuous belt and transfer the patient from the first surface to the second surface.

12. The system of claim 11, the disposable chuck comprising a sheet of substantially sterile material and at least one strip of adhesive adapted for removable attachment to the continuous belt, the at least one strip of adhesive attached along a first edge of the disposable chuck.

13. The system of claim 12, the disposable chuck further comprising at least one other strip of adhesive adapted for removable attachment of the disposable chuck to the continuous belt, the strips of adhesive being parallel to one another and parallel to the first edge of the disposable chuck.

14. The system of claim 12, further comprising a reinforcement sheet made of a material configured to reinforce the substantially sterile material, the reinforcement sheet having handholds configured to transfer the patient by grabbing the reinforcement sheet and pulling.

15. A system configured for transferring a patient, the system comprising:

a housing dimensioned to span a distance between a first surface at a first side of the housing and a second surface at a second side of the housing, the housing including:

a first end cap and a second end cap, each of the first and second end caps dimensioned to span the distance between the first surface at the first side of the housing and the second surface at the second side of the housing;

a first elongated frame member forming the first side of the housing; and a second elongated frame member forming the second side of the housing;

wherein the first and second end caps attach to the first and second elongated frame members to form the housing;

a continuous belt positioned in conveying relation with respect to a bridge positioned within the continuous belt and configured for a portion of the continuous belt to convey the patient while another portion of the continuous belt passes through the housing, wherein the bridge is further configured to supportthe patient and the continuous belt does not touch the first surface or the second surface;

a disposable chuck loaded onto the continuous belt and having a portion inserted into an opening between the continuous belt and the housing, wherein the disposable chuck is configured to be pulled in order to transfer the patient in a supine position from the first surface to the second surface; and a support structure comprising the bridge positioned within the continuous belt and connected to the first end cap and the second end cap within the housing, the bridge configured to support the patient as the patient is transferred from the first surface to the second surface.

16. The system of claim 15, wherein the end caps are configured to receive the ends of the bridge within the housing.

17. The system of claim 16, wherein the first and second sides of the housing each include a sloped transition area having a slope and a width.

* * * * *

UNITED STATES PATENT AND TRADEMARK OFFICE

CERTIFICATE OF CORRECTION

PATENT NO. : 8,782,826 B2
APPLICATION NO. : 13/626457
DATED : July 22, 2014
INVENTOR(S) : Ty A. White et al.

It is certified that error appears in the above-identified patent and that said Letters Patent is hereby corrected as shown below:

In the Claims

At Column 16, Line 53,
"to passover the support"

should read:
--to pass over the support--

At Column 18, Line 20,
"configured to supportthe patient"

should read:
--configured to support the patient--

Signed and Sealed this
Twenty-seventh Day of January, 2015

Michelle K. Lee

Michelle K. Lee
*Deputy Director of the United States Patent and Trademark Office*